US011447944B2

(12) United States Patent
Charest et al.

(10) Patent No.: US 11,447,944 B2
(45) Date of Patent: Sep. 20, 2022

(54) EXTERIOR WALL PANEL AND EXTERIOR WALL PANEL ASSEMBLY

(71) Applicant: OIKOS CONCEPT INC., Quebec (CA)

(72) Inventors: Pierre-Yves Charest, Quebec (CA); Francois Tremblay, Quebec (CA)

(73) Assignee: OIKOS CONCEPT INC., Quebec (CA)

( * ) Notice: Subject to any disclaimer, the term of this patent is extended or adjusted under 35 U.S.C. 154(b) by 0 days.

(21) Appl. No.: 16/771,545

(22) PCT Filed: Dec. 12, 2018

(86) PCT No.: PCT/CA2018/051587
§ 371 (c)(1),
(2) Date: Jun. 10, 2020

(87) PCT Pub. No.: WO2019/113698
PCT Pub. Date: Jun. 20, 2019

(65) Prior Publication Data

US 2021/0180309 A1 Jun. 17, 2021

Related U.S. Application Data

(60) Provisional application No. 62/597,558, filed on Dec. 12, 2017.

(51) Int. Cl.
*E04B 1/00* (2006.01)
*E04B 1/14* (2006.01)
(Continued)

(52) U.S. Cl.
CPC ..... *E04B 1/14* (2013.01); *E04C 2/386* (2013.01); *E04C 2/296* (2013.01); *E04C 2002/004* (2013.01)

(58) Field of Classification Search
CPC .... E04C 2002/004; E04C 2/296; E04C 2/386; E04B 1/14
See application file for complete search history.

(56) References Cited

U.S. PATENT DOCUMENTS 2,582,144 A * 1/1952 Miles ..... E04C 2/243 52/404.1
2,862,254 A 12/1958 Meek
(Continued)

FOREIGN PATENT DOCUMENTS

CA 1059287 A 7/1979
CA 2549707 A1 12/2007
(Continued)

OTHER PUBLICATIONS

Office Action dated Nov. 17, 2021; Eurasian Patent Organization; Eurasian Patent Office—Notification on the requirement to provide additional materials.

*Primary Examiner* — Basil S Katcheves
(74) *Attorney, Agent, or Firm* — The Watson IP Group, PLC; Jovan N. Jovanovic

(57) ABSTRACT

The present disclosure concerns an exterior wall panel comprising a wall framework defining inner and outer wall surfaces and having peripheral edges. The exterior wall panel further comprises a vapor barrier membrane superposed to the inner wall surface and covering at least one peripheral edge and being secured thereto, a weather barrier membrane superposed to the outer wall surface and covering at least one peripheral edge and being secured thereto. The present disclosure also concerns an external wall panel assembly comprising a plurality of such external wall panels and a method for forming such an exterior wall panel assembly.

25 Claims, 31 Drawing Sheets

(51) Int. Cl.

| | |
|---|---|
| ***E04C 2/38*** | (2006.01) |
| *E04C 2/296* | (2006.01) |
| *E04C 2/00* | (2006.01) |

(56) References Cited

U.S. PATENT DOCUMENTS

| | | | | |
|---|---|---|---|---|
| 3,139,369 | A * | 6/1964 | Sullivan | B31D 3/0284 156/563 |
| 3,363,383 | A * | 1/1968 | La Barge | E04B 1/68 52/471 |
| 4,567,701 | A | 2/1986 | Biggs et al. | |
| 4,813,193 | A * | 3/1989 | Altizer | E04B 1/14 52/210 |
| 5,502,939 | A * | 4/1996 | Zadok | E04B 1/6129 52/309.9 |
| 6,055,786 | A * | 5/2000 | Hubbard | E04D 5/12 116/205 |
| 6,279,284 | B1 * | 8/2001 | Moras | E04B 1/10 52/105 |
| 7,607,271 | B2 * | 10/2009 | Griffin | E04C 2/296 52/478 |
| 8,621,804 | B2 | 1/2014 | Houle | |
| 2002/0029535 | A1 | 3/2002 | Loper | |
| 2002/0164447 | A1 * | 11/2002 | Asgian | E04D 12/002 428/40.1 |
| 2003/0106668 | A1 * | 6/2003 | Cowie | E06B 1/62 165/10 |
| 2006/0174573 | A1 * | 8/2006 | Melencion | E04F 13/007 52/506.01 |
| 2011/0173925 | A1 * | 7/2011 | Brown | E04C 2/386 52/794.1 |
| 2011/0258944 | A1 * | 10/2011 | Radoane | E04B 1/665 52/62 |
| 2011/0277407 | A1 | 11/2011 | Masure et al. | |
| 2012/0137610 | A1 * | 6/2012 | Knight | E04B 2/58 52/309.1 |
| 2014/0115988 | A1 * | 5/2014 | Sievers | E04F 13/007 52/302.1 |
| 2015/0128518 | A1 * | 5/2015 | Knight | E04F 13/0862 52/404.1 |

FOREIGN PATENT DOCUMENTS

| | | | |
|---|---|---|---|
| CH | 674233 | A5 | 5/1990 |
| DE | 2648935 | A1 | 5/1978 |
| DE | 10006492 | A1 | 8/2001 |
| EA | 201100331 | A1 | 10/2011 |
| EP | 2458102 | A1 | 5/2012 |
| FR | 2325773 | | 4/1977 |
| FR | 2865750 | A1 | 8/2005 |
| FR | 2923848 | A1 | 5/2009 |
| GB | 578600 | A | 7/1946 |
| GB | 1019484 | A | 2/1966 |
| GB | 1229921 | A | 4/1971 |
| GB | 1440399 | A | 6/1976 |
| GB | 2238329 | | 5/1991 |
| JP | 2005213841 | A | 8/2011 |
| KR | 101180075 | B1 | 9/2012 |
| KR | 101353828 | B1 | 1/2014 |
| RU | 2463411 | C1 | 10/2012 |
| WO | 8404939 | A1 | 12/1984 |
| WO | 9712099 | A1 | 4/1997 |
| WO | 2012134331 | A1 | 10/2012 |
| WO | 2017037438 | A1 | 3/2017 |

* cited by examiner

EXTERIOR WALL PANEL AND EXTERIOR WALL PANEL ASSEMBLY

CROSS-REFERENCE TO RELATED APPLICATION

This application claims the benefit of U.S. Provisional application 62/597,558 filed on Dec. 12, 2017 and entitled "EXTERIOR WALL PANEL AND EXTERIOR WALL PANEL ASSEMBLY". This U.S. Provisional patent application is incorporated herein by reference in its entirety.

TECHNICAL FIELD OF THE INVENTION

The technical field relates to exterior wall panels, more specifically to exterior wall panels that are assembled in factories and ready for the construction of residential, commercial, and industrial buildings. It also relates to assemblies comprising such exterior wall panels that are sealed against air and moisture transfer.

BACKGROUND

Exterior wall panels typically comprise a framework, a heat insulating layer and protective membranes to protect the panels from outdoor conditions, to drain water, and to prevent condensation from forming indoors and/or outdoors. The heat insulating layer typically comprises a wool insulation portion.

Pre-manufactured exterior wall panels are manufactured in a controlled factory setting enabling quality inspection of the product, whereas conventional building techniques require erection of the walls on-site in fluctuating weather conditions. It is known in the art that the use of pre-manufactured wall panels and components facilitates the erection process on-site, reduces the building time and prevents schedule setbacks due to weather conditions, thus reducing building costs.

However, the protective membranes designed for covering the wall panels are typically partially secured to the wall panels in the factory and fully sealed to the wall panels on-site during erecting. The end portions of the protective membranes are left loose, or unsecured, to a wall surface, until adjacent wall panels are juxtaposed to erect a wall panel assembly. The pre-fabricated wall panels must therefore be stored indoors until they are sealed to one another on-site, and thus require considerable storage space.

In view of the above, there is a need for exterior wall panels and exterior wall panel assemblies which would be able to overcome or at least minimize some of the above-discussed prior art concerns.

BRIEF SUMMARY OF THE INVENTION

According to a general aspect, there is provided an exterior wall panel comprising a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges; a vapor barrier membrane superposed to the inner wall surface and covering at least partially at least one of the first pair of spaced-apart peripheral edges and the second pair of spaced-apart peripheral edges and being secured thereto; and a weather barrier membrane superposed to the outer wall surface and covering at least partially at least one of the first pair of spaced-apart peripheral edges and the second pair of spaced-apart peripheral edges and being secured thereto.

In an embodiment, the vapor barrier membrane and the weather barrier membrane overlap along at least a portion of at least one of the first pair of spaced-apart peripheral edges and the second pair of spaced-apart peripheral edges.

In an embodiment, the exterior wall panel further comprises a bonding joint applied to at least one of the vapor barrier membrane and the weather barrier membrane and extending along at least one of the first pair of spaced-apart peripheral edges and the second pair of spaced-apart peripheral edges, the bonding joint contacting at least one of the vapor barrier membrane and the weather barrier membrane of another exterior wall panel when configured in an adjacent and abutting configuration.

In an embodiment, the bonding joint comprises a pressure sensitive adhesive strip.

In an embodiment, the exterior wall panel further comprises a rigid flashing having a first section superposed to the outer wall surface and a second section extending past at least one of the first pair of spaced-apart peripheral edges and the second pair of spaced-apart peripheral edges.

In an embodiment, the first section of the rigid flashing is superposed and secured to one of the weather barrier membrane and the vapor barrier membrane and the second section of the rigid flashing is superposable and securable to one of a weather barrier membrane and a vapor barrier membrane of an adjacently configured exterior wall panel.

In an embodiment, the first section of the rigid flashing is inserted between the wall framework and the weather barrier membrane.

In an embodiment, the second section is superposable outwardly to the weather barrier membrane of the adjacently configured exterior wall panel.

In an embodiment, the exterior wall panel further comprises a rigid heat insulating panel superposed to the wall framework outwardly thereof with the weather barrier membrane being superposed outwardly to the rigid heat insulating panel; an outer siding superposed outwardly to the rigid heat insulating panel and the weather barrier membrane; and a plurality of spaced-apart slats extending between the weather barrier membrane and the outer siding.

In an embodiment the plurality of spaced-apart slats are configured in a superimposed configuration and form a plurality of slat layers between the weather barrier membrane and the outer siding.

In an embodiment, the exterior wall panel further comprises a rigid flashing having a first section superposed and secured to the rigid heat insulating panel and at least partially covered outwardly by the weather barrier membrane; and a second section extending past at least one of the first pair of spaced-apart peripheral edges and the second pair of spaced-apart peripheral edges and superposable outwardly to a weather barrier membrane of an adjacently configured exterior wall panel.

In an embodiment, the first section of the rigid flashing is at least partially sandwiched between the weather barrier membrane and the vapor barrier membrane.

In an embodiment, the first section of the rigid flashing extends between the rigid heat insulating panel and the weather barrier membrane.

In an embodiment, the exterior wall panel further comprises a bonding joint applied to at least one of the vapor barrier membrane and the weather barrier membrane and extending along at least one of the first pair of spaced-apart peripheral edges and the second pair of spaced-apart peripheral edges, the bonding joint contacting at least one of the vapor barrier membrane and the weather barrier membrane of the adjacently configured exterior wall panel, wherein the rigid flashing shields the bonding joint between the exterior wall panel and the adjacently configured exterior wall panel.

In an embodiment, the exterior wall panel further comprises a structural panel abutting against and mounted to the wall framework inwardly thereof and extending at least partially between the vapor barrier membrane and the wall framework.

In an embodiment, the wall framework defines an inner space and the exterior wall panel further comprises a heat insulating layer extending inside the inner space and between the structural panel and the rigid heat insulating panel.

In an embodiment, the first pair of spaced-apart peripheral edges includes an upper edge and a lower edge and the second pair of spaced-apart peripheral edges includes side edges.

In an embodiment, the rigid heat insulating panel comprises a beveled edge extending downwardly from the outer wall surface and the second section of the rigid flashing is superposable to the beveled edge of the adjacently configured exterior wall panel.

According to another general aspect, there is provided an exterior wall panel assembly, comprising a plurality of exterior wall panels according to the present disclosure, the plurality of exterior wall panels being configured in an adjacent and abutting configuration.

According to another general aspect, there is provided a method for forming an exterior wall panel assembly, comprising: providing a first exterior wall panel according to the present disclosure, applying a bonding joint to at least one of the first pair of spaced-apart peripheral edges and the second pair of spaced-apart peripheral edges of the first exterior wall panel, providing a second exterior wall panel according to the present disclosure, and configuring the second exterior wall panel in an adjacent and abutting configuration with regards to the first exterior wall panel, wherein at least one of the first pair of spaced-apart peripheral edges and the second pair of spaced-apart peripheral edges of the second exterior wall panel contacts the bonding joint.

According to another general aspect, there is provided an exterior wall panel assembly, comprising a plurality of exterior wall panels configured in an adjacent and abutting configuration, each one of said plurality of exterior wall panels comprising a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges; a vapor barrier membrane superposed to the inner wall surface and covering at least partially at least one of the first pair of spaced-apart peripheral edges and the second pair of spaced-apart peripheral edges and being secured thereto; and a weather barrier membrane superposed to the outer wall surface and covering at least partially at least one of the first pair of spaced-apart peripheral edges and the second pair of spaced-apart peripheral edges and being secured thereto.

According to a general aspect, there is provided an exterior wall panel. The exterior wall panel comprises a wall framework that comprises a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges; a vapor barrier membrane superposed to the inner wall surface and covering at least partially at least one of the first pair of spaced-apart peripheral edges and the second pair of spaced-apart peripheral edges and being secured thereto; a weather barrier membrane superposed to the outer wall surface and covering at least partially at least one of the first pair of spaced-apart peripheral edges and the second pair of spaced-apart peripheral edges and being secured thereto; and a bonding joint applied to at least one of the vapor barrier membrane and the weather barrier membrane and extending along at least one of the peripheral edges, the bonding joint contacting at least one of the vapor barrier membrane and the weather barrier membrane of another exterior wall panel when configured in an adjacent configuration.

According to another general aspect, there is provided an exterior wall panel. The exterior wall panel comprises a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges; a vapor barrier membrane superposed to the inner wall surface and being secured thereto, the vapor barrier membrane extending past at least one of the peripheral edges and being superposable to a vapor barrier membrane of another exterior wall panel when configured in an adjacent configuration; a weather barrier membrane superposed to the outer wall surface and being secured thereto; a rigid flashing superposed to the outer wall surface and extending past at least one of the peripheral edges, the rigid flashing being superposable and securable to a weather barrier membrane of another exterior wall panel when configured in an adjacent configuration, and a bonding joint applied to and extending along at least one of the peripheral edges, the bonding joint contacting at least one peripheral edge of another exterior wall panel when configured in an adjacent configuration.

In an embodiment, the bonding joint comprises a pressure sensitive adhesive strip.

In an embodiment, the exterior wall panel further comprises a structural panel abutting against and mounted to the wall framework, the vapor barrier membrane being superposed outwardly to the structural panel; a rigid heat insulating panel abutting against the wall framework, the weather barrier membrane being superposed outwardly to the rigid heat insulating panel; the wall framework defining an inner space and the exterior wall panel further comprising a heat insulating layer inside the inner space and between the structural panel and the rigid heat insulating panel; and an outer siding superposed outwardly to the rigid heat insulating panel.

In an embodiment, the first pair of spaced-apart peripheral edges includes an upper edge and a lower edge and the second pair of spaced-apart peripheral edges includes side edges.

According to still another general aspect, there is provided an exterior wall panel assembly that comprises a plurality of exterior wall panels configured in an adjacent configuration. Each one of the exterior wall panels comprises a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges; a vapor barrier membrane superposed to the inner wall surface and covering at least partially at least one of the first pair of spaced-apart peripheral edges and the second pair of spaced-apart peripheral edges and being secured thereto; a weather barrier membrane superposed to the outer wall surface and covering at least partially at least one of the first pair of spaced-apart peripheral edges and the second pair of spaced-apart peripheral edges and being secured thereto; and a bonding joint applied to at least one of the vapor barrier membrane and the weather barrier membrane and extending along at least one of the peripheral edges; when configured in an adjacent configuration, the bonding joint of a first one of the exterior wall panels contacts at least one of the vapor barrier membrane and the weather barrier membrane of an adjacent one of the exterior wall panels to provide a seal inbetween.

According to still a further general aspect, there is provided an exterior wall panel assembly that comprises a plurality of exterior wall panels configured in an adjacent configuration. Each one of the exterior wall panels comprises a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges; a vapor barrier membrane superposed to the inner wall surface and being secured thereto, the vapor barrier membrane extending past at least one of the peripheral edges; a weather barrier membrane superposed to the outer wall surface and being secured thereto; a rigid flashing superposed to the outer wall surface and extending past at least one of the peripheral edges, and a bonding joint applied to and extending along at least one of the peripheral edges; when configured in an adjacent configuration, the bonding joint of a first one of the exterior wall panels contacts at least one peripheral edge of another exterior wall panel, the vapor barrier membrane of a first one of the exterior wall panels is superposable to a vapor barrier membrane of another exterior wall panel and the rigid flashing of a first one of the exterior wall panels is superposable and securable to a weather barrier membrane of another exterior wall panel.

According to still a further general aspect, there is provided an exterior wall panel that comprises a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges; the horizontal stud members having an outer inclined edge extending downwardly towards the outer wall surface; and a drainage barrier superposed to at least one of the outer inclined edge and to the outer wall surface and being secured thereto, the drainage barrier being engageable to the outer inclined edge of another exterior wall panel when configured in an adjacent configuration to drain water.

In an embodiment, the exterior wall panel further comprises a vapor barrier membrane superposed to the inner wall surface and being secured thereto, the vapor barrier membrane extending past at least one of the peripheral edges and being superposable to a vapor barrier membrane of another exterior wall panel when configured in an adjacent configuration; a rigid heat insulating panel abutting against the outer wall surface of the wall framework and having a beveled edge extending downwardly from the outer wall surface, the drainage barrier being superposed to the beveled edge of the rigid heat insulating panel and secured outwardly thereto; and a weather barrier membrane superposed outwardly to the rigid heat insulating panel and being secured thereto.

In an embodiment, the drainage barrier comprises a rigid flashing.

BRIEF DESCRIPTION OF THE DRAWINGS

It will be noted that throughout the appended drawings, like features are identified by like reference numerals.

DETAILED DESCRIPTION

Figure 1:
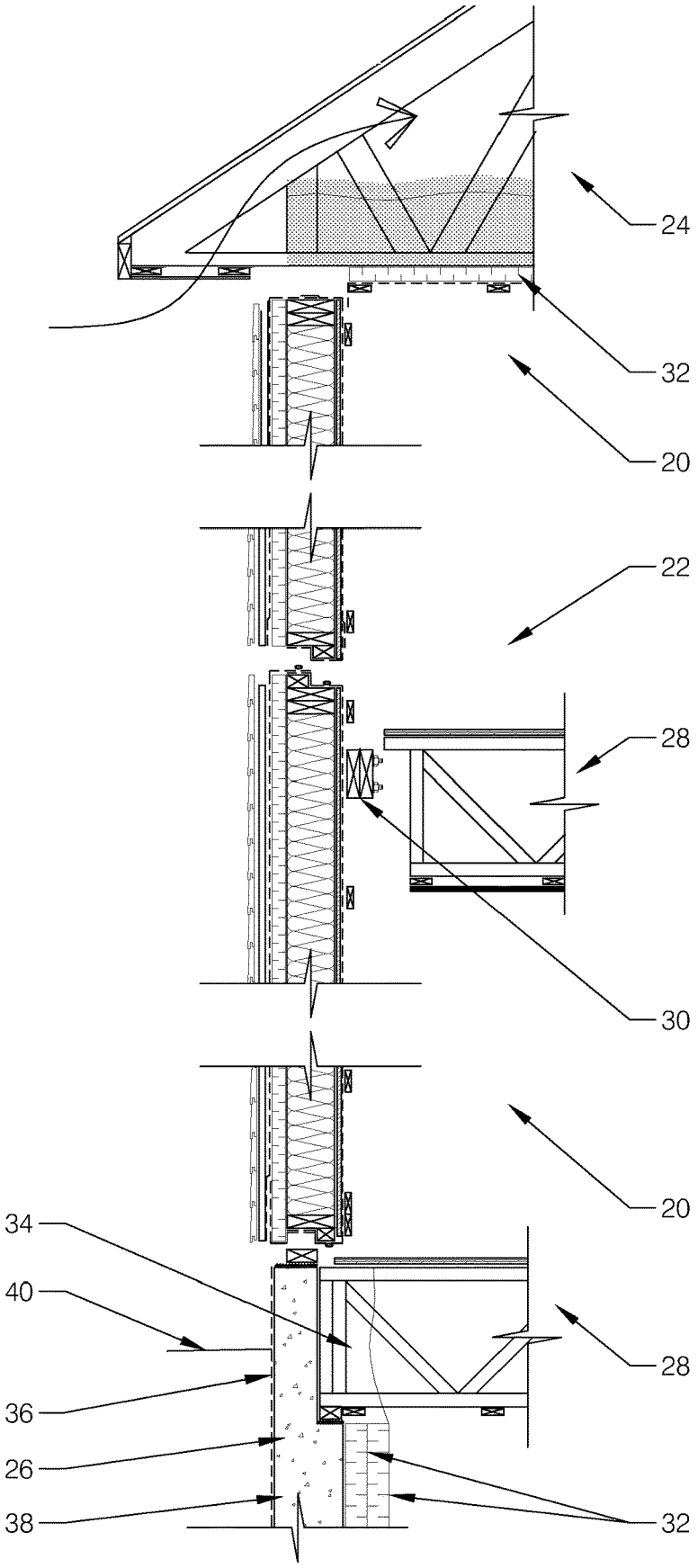
FIG. 1 is a cross-section view, fragmented, of two exterior wall panels shown within their environment that includes a roof structure, a foundation wall and floor trusses, according to an embodiment.

Moreover, although the embodiments of the exterior wall panel and exterior wall panel assembly and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the exterior wall panel and exterior wall panel assembly, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "inner", "outer", "above", "below", "forward", "rearward", "left", "right" and the like should, unless otherwise indicated, be taken in the context of the figures and correspond to the position and orientation of the exterior wall panel and exterior wall panel assembly and corresponding parts, with the term "inner" corresponding to a position oriented towards a spacing inside of a building defined by an assembly of multiple exterior wall panels or exterior wall panel assemblies and the term "outer" meaning externally of the inner spacing. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, the term "about" means within an acceptable error range for the particular value as determined by one of ordinary skill in the art, which will depend in part on how the value is measured or determined, i.e. the limitations of the measurement system. It is commonly accepted that a 10% precision measure is acceptable and encompasses the term "about".

Referring to FIG. 1, there is shown an embodiment of a pair of exterior wall panels 20 to be joined to form an exterior wall panel assembly 22 for a building that includes a roof 24, a foundation wall 26 and floor trusses 28. In an embodiment, the foundation wall 26 is made of concrete. The environment of the exterior wall panel assembly 22 also includes horizontal stud members 30 secured to one of the exterior wall panels 20, inwardly thereof, to receive and support the floor trusses 28. The roof 24 and the foundation wall 26 may be provided with rigid heat insulating panels 32 at interfaces with the exterior wall panel assembly 22 and the floor trusses 28 in accordance with the climate and building codes for example. Typically, another heat insulating material such as and without being limitative expanded polyurethane 34 can be applied in regions of the floor truss 28 adjoining the foundation wall 26 for insulation purposes. As shown, a weather barrier membrane 36 covers an outer surface 38 of the concrete foundation wall 26 and acts as a means for draining water off the wall 26. A schematic line shows the ground cable 40 position with respect to the wall 26.

Multiple embodiments of exterior wall panels 20 and exterior wall panel assemblies 22 will be described below, but the environment and foundation wall 26 onto which the exterior wall panels 20 and the exterior wall panel assemblies 22 are mounted to are substantially similar or share similar features.

Figure 2A:
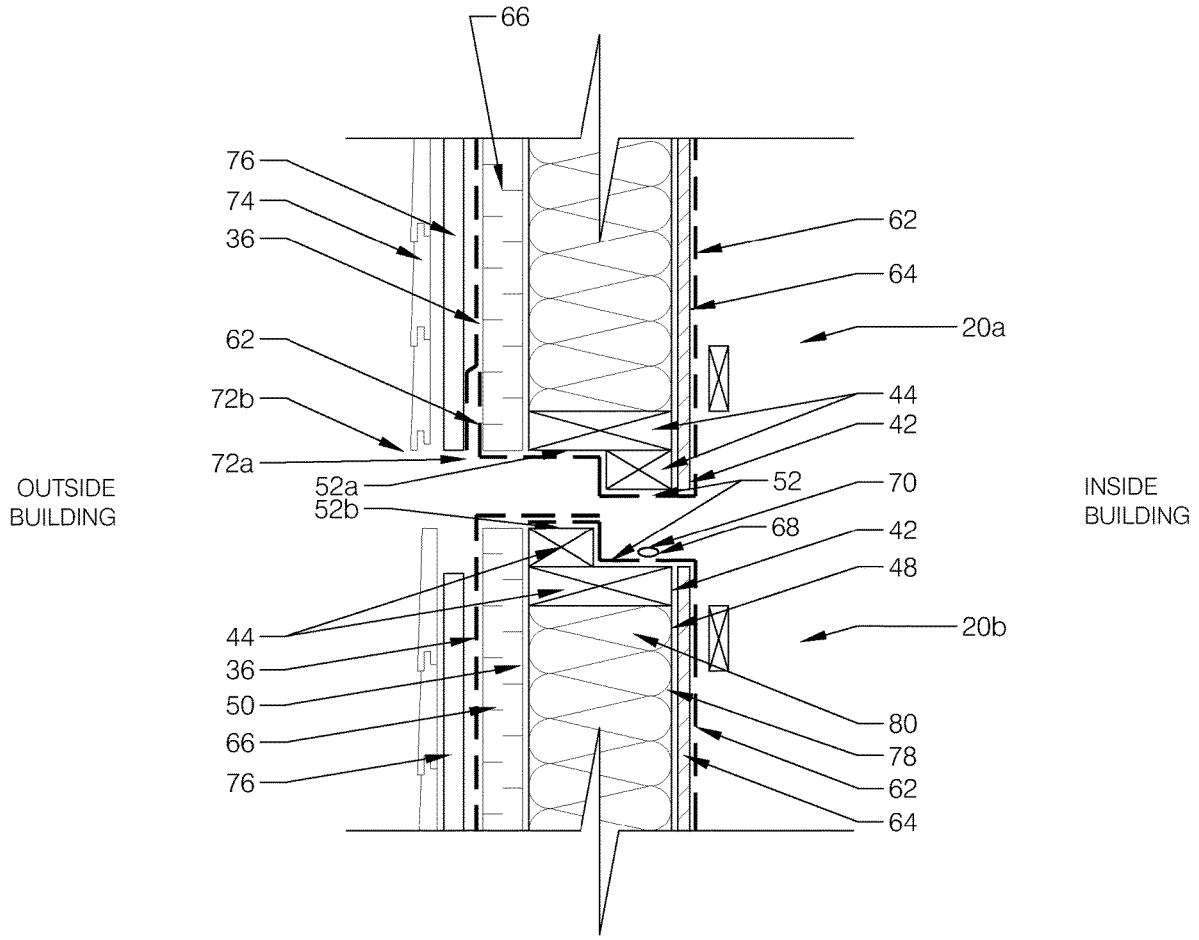
FIG. 2A is a cross-section view, fragmented, of two exterior wall panels configured in a spaced-apart configuration, with a vapor barrier membrane and a weather barrier membrane covering peripheral edges of the exterior wall panels, according to an embodiment.
Figure 2B:
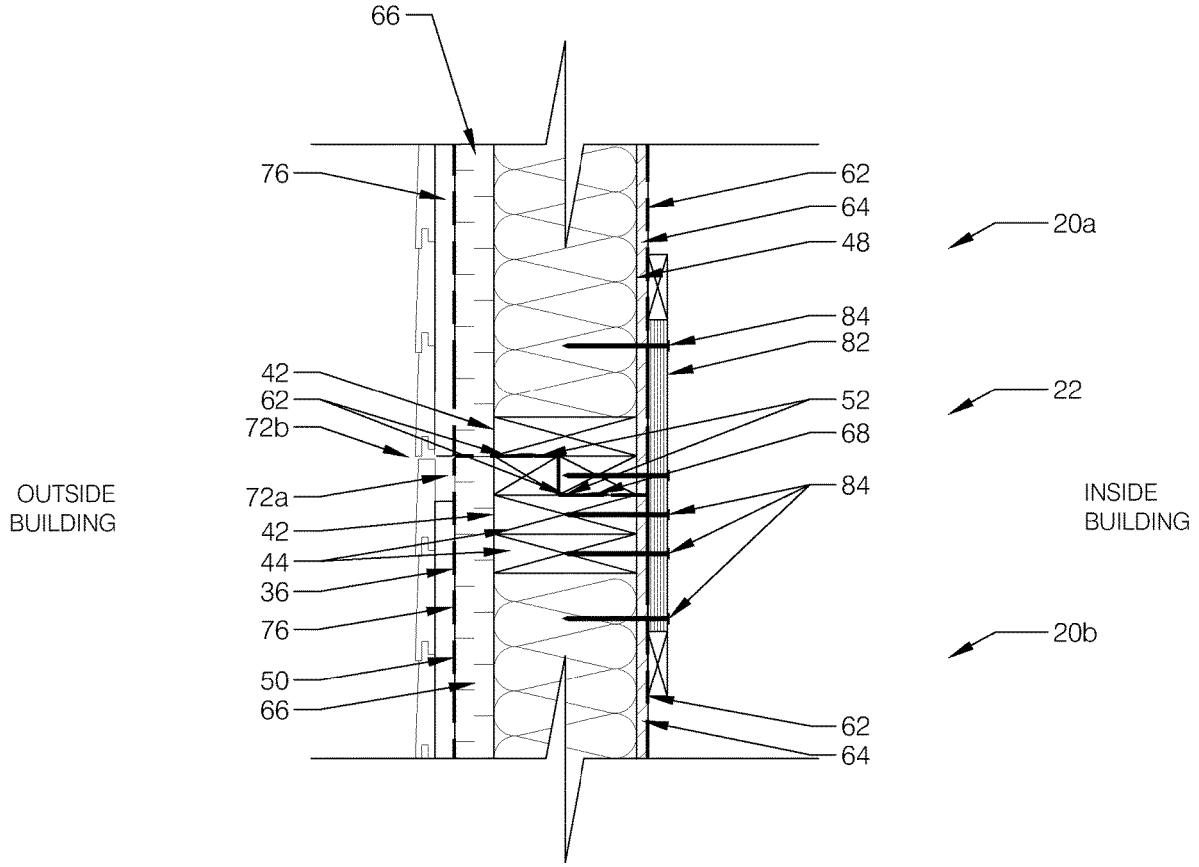
FIG. 2B is a cross-section view, fragmented, of an exterior wall panel assembly, showing the two exterior wall panels of FIG. 2A configured in a vertically-adjacent configuration.

Referring to FIGS. 2A and 2B, there is shown an embodiment of a pair of exterior wall panels 20 to be joined to form an exterior wall panel assembly 22 (to better show their interconnection, only the upper and lower portions thereof are shown). As shown, the exterior wall panels 20 are configurable in a vertically-adjacent configuration. It can be appreciated that the lower portion of the first wall panel 20*a*, i.e. the upper panel, placed above the second wall panel 20*b*, i.e. the lower panel, may also correspond to the lower portion of the second wall panel and that the upper portion of the second wall panel may also correspond to the upper portion of the first wall panel.

Each exterior wall panel 20 comprises a wall framework 42. The wall framework 42 includes a plurality of horizontal stud members 44 and a plurality of vertical stud members 46 (see FIG. 4B). In a non-limitative embodiment, the stud members 44, 46 are made of wood and have a substantially rectangular cross-section. For instance and without being limitative, the stud members can have a cross-section of nominal sizes such as 2×3", 2×4", 2×6" or any other appropriately sized stud members. By nominal, it is understood by one of skill in the art that the actual size of the member is lower than the nominal size. For example, a 2×3" member has dimensions of 1½" by 2½". It can be appreciated that the stud members 44, 46 can be made of other structural materials such as concrete or metal and have different cross-sections.

The stud members 44, 46 define together an inner wall surface 48 and an outer wall surface 50, the outer wall surface 50 being spaced-apart from the inner wall surface 48. As can be appreciated, the inner wall surface 48 is facing a spacing inside of a building whereas the outer wall surface 50 is exposed to the outside of the building. The inner and outer wall surfaces 48, 50 are spaced-apart from one another to define an inner space 78 in which building heat insulating elements can be received. In the embodiment shown, as building heat insulating element, the exterior wall panel 20 comprises an heat insulating layer 80 inserted and located inside the inner space 78. The heat insulating layer 80 typically comprises a mineral wool material, but it can be appreciated that any material having heat insulating properties may be used.

In an embodiment, the wall framework 42 defines a first pair of spaced-apart peripheral edges 52 and a second pair of spaced-apart peripheral edges 54 (see FIG. 3A) extending between the first pair of spaced-apart peripheral edges 52. As shown on FIGS. 2A, 2B, 2C and 2D, the exterior wall panels 20 are configured in a vertically adjacent configuration, but as shown on FIGS. 3A and 3B, they are positioned in a horizontally adjacent configuration and in FIGS. 4A, 4B, 4C, 5A and 5B, they are positioned in a corner configuration, as described in more details below. The first pair of spaced-apart peripheral edges 52 can therefore include an upper edge 52*a* and a lower edge 52*b* and the second pair of spaced-apart peripheral edges 54 can include side edges according to the vertical, horizontal or corner configurations. It can be appreciated that in an alternative embodiment (not shown) of an exterior wall panel used as a roof component, the first pair of spaced-apart peripheral edges and the second pair of spaced-apart peripheral edges include side edges.

Referring to FIGS. 2A and 2B, the exterior wall panel 20 further includes a vapor barrier membrane 62 superposed to the inner wall surface 48. By superposed, it is meant that the vapor barrier membrane 62 is placed above or over the inner wall surface 48, but it is not necessarily in contact with the inner wall surface 48. For example, in an embodiment that will be described in more details below, the exterior wall panel 20 further includes a structural panel 64 abutting against and mounted to the wall framework 42. The structural panel 64 extends between the inner wall surface 48 and the vapor barrier membrane 62. In this embodiment, the vapor barrier membrane 62 is indirectly superposed to the inner wall surface 48 and is covering (in contact—either directly or indirectly—with) and secured to the structural panel 64. In the embodiment shown in FIGS. 2A and 2B, the vapor barrier membrane 62 covers at least partially at least one of the first pair of spaced-apart peripheral edges 52 and the second pair of spaced-apart peripheral edges 54 of the wall framework 42 and is secured thereto. The verb "superpose" should be understood, in the present description, in the meaning of placing or laying over or above whether in or not in contact. Moreover, in the present description, the verb "cover" should be understood in the meaning of overlaying or spreading over something, either directly or indirectly.

Water vapor may cause numerous problems in buildings when its flow is not controlled. The accumulation of moisture may cause mold, mildew and damages. The direction of travel of water vapor is typically from the inside to the outside of a building in cold climates such as in Canada and northern United States. The use of air conditioning in warmer temperatures lowers the humidity level and results in water vapor flow from the outside to the inside of the building. In the embodiment shown, the vapor barrier membrane 62 is superposed to the inner wall surface 48 and is designed to prevent water vapor from condensing on the wall surface inside of the building, due to higher water vapor pressure inside, as it may occur in colder climates. In warmer climates, it can therefore be appreciated that the vapor barrier membrane can cover and be secured to the outer wall surface defined by the stud members (not shown). It can be appreciated that the vapor barrier membrane 62 can be made of any suitable material to provide water vapor diffusion resistance such as and without being limitative polymer (e.g. polyethylene) or metallic sheets or foil.

The exterior wall panel 20 further includes a weather barrier membrane 36 that is superposed to the outer wall surface 50. By superposed, it is meant that the weather barrier membrane 36 is placed above or over the outer wall surface 50, but it is not necessarily in contact with the outer wall surface 50. In an embodiment, the exterior wall panel 20 includes a rigid heat insulating panel 66 abutting against the wall framework 42 and placed between the outer wall surface 50 and the weather barrier membrane 36. The weather barrier membrane 36 may cover at least partially at least one of the first pair of spaced-apart peripheral edges 52 and the second pair of spaced-apart peripheral edges 54 of the wall framework 42. The weather barrier membrane 36 can be secured to the peripheral edges 52, 54 using adhesive strips (not shown) or any other suitable mechanical fasteners.

It can be appreciated that the weather barrier membrane 36 can be made of any suitable material to drain water off an outer surface of the rigid heat insulating panel 66, such as and without being limitative polyethylene fiber membrane (e.g. Tyvek®).

In the embodiment shown on FIGS. 2A and 2B, the vapor barrier membrane 62 extends from the inner side of the wall framework 42 to cover one edge of the first pair of spaced-apart peripheral edges 52 and further partially cover outwardly the rigid heat insulating panel 66 on the outer side of the wall framework 42, with a section extending below the weather barrier membrane 36. As the weather barrier membrane 36, it can be appreciated that the vapor barrier membrane 62 can be secured to the peripheral edges 52, 54 and the rigid heat insulating panel 66 using adhesive strips (not shown) or any other suitable mechanical fasteners.

In an embodiment, the vapor barrier membrane 62 and the weather barrier membrane 36 are mounted and secured to the exterior wall panel 20 in the factory. As shown in the Figures, the weather barrier membrane 36 can partially overlap the vapor barrier membrane 62 along a portion of the peripheral edges 52, 54 of the wall framework 42. As mentioned above, the vapor barrier membrane 62 and the weather barrier membrane 36 may be mounted interchangeably on the exterior wall panel 20 according to the climate, i.e. in some implementations, the vapor barrier membrane 62 may be mounted externally of the exterior wall panel 20 and the weather barrier membrane 36 may be mounted internally of the exterior wall panel 20. In some implementations (not shown), the vapor barrier membrane 62 may overlap the weather barrier membrane 36. The membranes typically overlap one another on a length ranging from 1" to 12".

As shown on FIG. 2A, the lower exterior wall panel 20*b* further comprises a bonding joint 68 applied to the vapor barrier membrane 62 along an upper one of the peripheral edges 52. The bonding joint 68 extends longitudinally along the respective one of the peripheral edges 52, 54 of the wall framework 42 and contacts the vapor barrier membrane 62 of another exterior wall panel 20*a* when configured in an adjacent configuration. The bonding joint 68 may alternatively be configured to contact the weather barrier membrane 36 of an adjacent one of the exterior wall panels. As described below, the bonding joint 68 may alternatively be applied to the weather barrier membrane 36 to contact either the weather barrier membrane 36 or the vapor barrier membrane 62 of an adjacent one of the exterior wall panels.

Now referring to FIG. 2B, there is shown an exterior wall panel assembly 22 that comprises the exterior wall panels 20*a*, 20*b* of FIG. 2A configured in the adjacent and engaged configuration. In this configuration, the bonding joint 68 provides a seal between adjacent exterior wall panels 20, between the engaged peripheral edges 52, 54. More particularly, the bonding joint 68 is squeezed (sandwiched) between the peripheral edges 52, 54 of the two adjacent and engaged exterior wall panels 20*a*, 20*b*.

The bonding joint 68 may therefore provide a seal between two vapor barrier membranes 62, two weather barrier membranes 36 or a vapor barrier membrane 62 and a weather barrier membrane 36 of two adjacent and engaged exterior wall panels 20*a*, 20*b*.

In the embodiment shown, the bonding joint 68 comprises a pressure sensitive adhesive strip 70 (as represented in FIG. 2A) to seal adjacent panels when put under the application of a force during erecting of the wall panel assembly 22. It can be appreciated that the bonding joint material can be any suitable material that provides an airtight seal between the exterior wall panels 20, such as and without being limitative butyl rubber. The bonding joint 68 is typically positioned with respect to the outer surface of the rigid heat insulating panel 66 in accordance to a dew point calculation. This calculation provides information on the thickness of the heat insulating panel, for example, which result varies according to the climate and the building indoor conditions.

As shown on FIG. 2A, one exterior wall panel 20*a* further comprises a rigid flashing 72*a* (or inner rigid flashing 72*a*) interposed between (or having at least a section sandwiched between) the vapor barrier membrane 62 and the weather barrier membrane 36 (or between overlapping portions of the vapor barrier membrane 62 and the weather barrier membrane 36) to prevent water from penetrating the joint formed between the adjacent and abutting peripheral edges 52, 54 and, more particularly, between the membranes overlapping.

The exterior wall panel 20 can also include an outer siding 74 mounted to the rigid heat insulating panel 66, with a plurality of spaced-apart slats 76 (for instance at least partially made of wood) extending inbetween. More particularly, the outer siding 74 is superposed outwardly to the rigid heat insulating panel 66 with the slats 76, such as and without being limitative 1" by 3" wood slats, extending inbetween.

In the embodiment shown in FIGS. 2A and 2B, at a lower peripheral edge thereof, the exterior wall panel 20*a* also includes a rigid flashing 72*b* (or additional rigid flashing 72*b* or outer rigid flashing 72*b*) inserted beneath the outer siding 74 and extending externally and downwardly to be superposed against the outer siding 74 of the vertically-adjacent exterior wall panel 20*b*. In the embodiment shown, the additional rigid flashing 72*b* (or outer rigid flashing 72*b*) comprises first and second portions substantially perpendicular to each other.

For instance and without being limitative, the rigid flashings 72*a*, 72*b* may be an aluminum sheet or any other rigid material suitable to shield the joint between the peripheral edges 52, 54, such as plastic or rubber, suitable to prevent water from entering the joint. In the embodiment shown, the exterior wall panels 20*a*, 20*b* comprise a drainage barrier including the rigid flashings 72*a*, 72*b*. It is understood that the present disclosure is not limited to rigid flashings 72*a*, 72*b* that would be at least partially made of a metallic material. Any other material having rigidity and/or impermeability properties, so as to drain water off the exterior wall panels configured in the adjacent configuration, could also be used.

It is appreciated that the construction, the shape, the configuration, and the location of the rigid flashing 72*a*, 72*b* with regards to the outer sidings 74, the slats 76, and the rigid heat insulating panels 76 can vary from the embodiments shown.

As shown on FIGS. 2A and 2B, the rigid flashing 72*a* is superposed to the outer wall surface 50 and extends past at least one of the peripheral edges 52, in this case, the upper edge. When configured in an adjacent configuration, the rigid flashing 72*a* of a first exterior wall panel 20*a* is superposable and securable to the weather barrier membrane 36 of a second exterior wall panel 20*b*. Moreover, as represented in FIG. 2B, at least one of the rigid flashings 72*a*, 72*b* is dimensioned and shaped to at least partially extend between the outer siding 74 and the rigid heat insulating panel 66 of the second exterior wall panel 20*b*.

In the embodiment shown, the slats 76 are thus configured to ease the securing of the outer siding 74 onto the rigid heat insulating layer 66, or directly onto the outer wall surface 50 defined by the stud members 44, 46 of the wall framework 42. The slats 76 are further configured to receive a portion of at least one of the rigid flashings 72*a*, 72*b* so as to contribute to the efficiency of the drainage barrier.

As mentioned above, the exterior wall panel 20 includes the structural panel 64 abutting against and mounted to the wall framework 42 on a side of the wall oriented towards the inner spacing of the building. In a non-limitative embodiment, the structural panel 64 is made of oriented strand board material, but it can be appreciated that any material having structural properties may be used. In an embodiment, the vapor barrier membrane 62 is superposed outwardly to the structural panel 64. As mentioned above, on a side of the wall oriented towards the outside of the building, the exterior wall panel 20 includes the rigid heat insulating panel 66 abutting against the wall framework 42. As shown, the weather barrier membrane 36 is superposed outwardly to the rigid heat insulating panel 66. In a non-limitative embodiment, the rigid heat insulating panel 66 comprises a polystyrene foam material, but it can be appreciated that any material having heat insulating and structural properties may be used.

As mentioned above, the heat insulating layer 80 is located inside the inner space 78 and between the structural panel 64 and the rigid heat insulating panel 66.

As shown on FIG. 2B and as mentioned above, when configured in an adjacent configuration, a plurality of exterior wall panels 20 form an exterior wall panel assembly 22. Each exterior wall panel 20 includes a wall framework 42, a vapor barrier membrane 62, a weather barrier membrane 36 and a bonding joint 68. In the adjacent configuration, the bonding joint 68 of a first one of the exterior wall panels 20 contacts at least one of the vapor barrier membrane 62 and the weather barrier membrane 36 of an adjacent one of the exterior wall panels 20 to provide a seal inbetween. It can be appreciated that a bonding joint 68 may be pressed between the peripheral edges 52, 54 each at least partially covered by a vapor barrier membrane 62 or by a weather barrier membrane 36 or by both. As shown, when abutting against one another, the exterior wall panels 20 can be secured together with a structural board 82 superposed to the structural panels 64 of the adjacent and engaged exterior wall panels 20*a*, 20*b* and fastened to the stud members 44 of each wall panel 20 by structural connectors 84. It can be appreciated that the structural connectors 84 may comprise screws or nails.

Figure 2C:
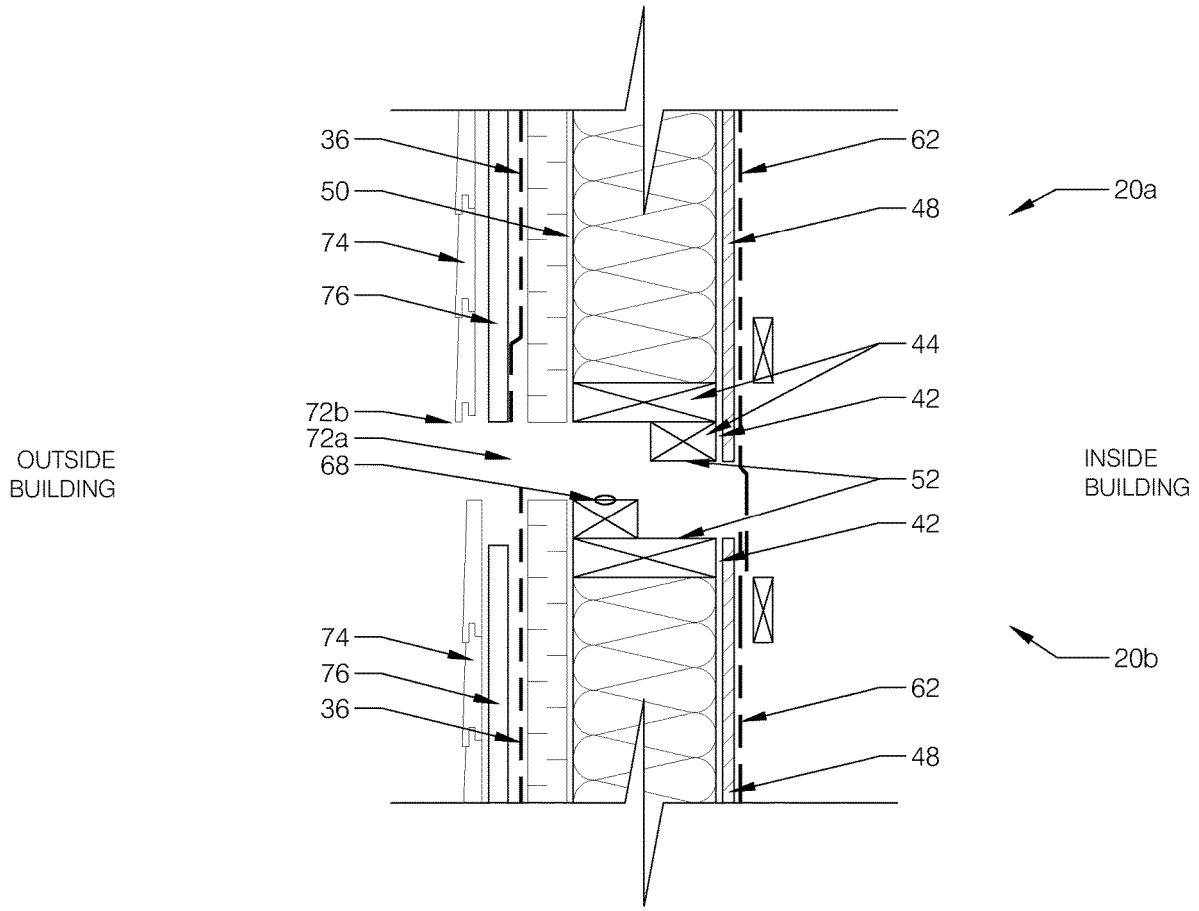
FIG. 2C is a cross-section view, fragmented, of two exterior wall panels configured in a spaced-apart configuration, with the vapor barrier membrane and the weather barrier membrane being respectively superposed to an inner and outer wall surfaces of the exterior wall panels, according to an embodiment.

Now referring to FIG. 2C, there is shown another embodiment of exterior wall panels 20 configurable in a vertically-adjacent configuration. The exterior wall panels 20 differ from the embodiment depicted in FIG. 2A with respect to the position of the vapor barrier membranes 62 and the weather barrier membranes 36 in that they do not cover the peripheral edges 52, 54 of the exterior wall panels 20. In the embodiment of FIG. 2C, the vapor barrier membrane 62 is superposed and secured to the inner wall surface 48 defined by the stud members 44 of the wall framework 42, and extends past at least one of the peripheral edges 52 of the wall framework 42. As shown, the vapor barrier membrane 62 of a first wall panel 20*a* extends towards a second wall panel 20*b* placed below and is superposable to the vapor barrier membrane 62 of the second wall panel 20*b* when it is configured in an adjacent and engaged configuration. Thus, in the embodiment shown, the vapor barrier membrane 62 extends past the lower peripheral edge 52 of the exterior wall panel 20*a*. It can be appreciated that the vapor barrier membrane 62 of the second wall panel 20*b* can also extend past a peripheral edge towards the first wall panel 20*a* to be superposable and securable thereto.

As mentioned above, the exterior wall panel assembly 22 further comprises a rigid flashing 72*a* that is superposed to the outer wall surface 50 and extends past a lower one of the peripheral edges 52. Each wall panel 20 is covered, on the outer wall surface 50, by the weather barrier membrane 36 that is secured thereto, the rigid flashing 72*a* has a first section extending between the rigid heat insulating panel 66 and the weather barrier membrane 36 of an upper one 20*a* of the exterior wall panels 20 and a second section extending downwardly past the lower peripheral edge 52 of the upper one 20*a* of the exterior wall panels 20. When two adjacent ones of the panels 20*a*, 20*b* are engaged together, the second section of the rigid flashing 72*a* of the upper one 20*a* of the exterior wall panels 20, is insertable between the weather barrier membrane 36 and the slats 76, i.e. externally of the weather barrier membrane 36, of the lower one 20*b* of the exterior wall panels 20. In the embodiment shown, the second section of the rigid flashing 72*a* is insertable between the weather barrier membrane 36 and the outer siding 74 of the lower one 20*b* of the exterior wall panels 20. Thus, when engaged between the weather barrier membrane 36 and the slats 76 or superposed externally to the lower one 20*b* of the exterior wall panels 20, the rigid flashing 72*a* shields the joint between adjacent ones of the exterior wall panels 20 when configured in the adjacent and engaged configuration. In the embodiment shown, the bonding joint 68 is not applied to the vapor barrier membrane 62 or to the weather barrier membrane 36, but it is applied directly to the stud members 44, 46 of the wall framework 42 and extends along at least one of the peripheral edges 52. In the adjacent and engaged configuration of the exterior wall panels 20, it contacts at least one peripheral edge 52 of another exterior wall panel 20. It is appreciated that, as in the embodiment shown in FIGS. 2A and 2B, the bonding joint 68 may alternatively be applied to the weather barrier membrane 36 or the vapor barrier membrane 62 to contact either the weather barrier membrane 36 or the vapor barrier membrane 62 of an adjacent one of the exterior wall panels.

Figure 2D:
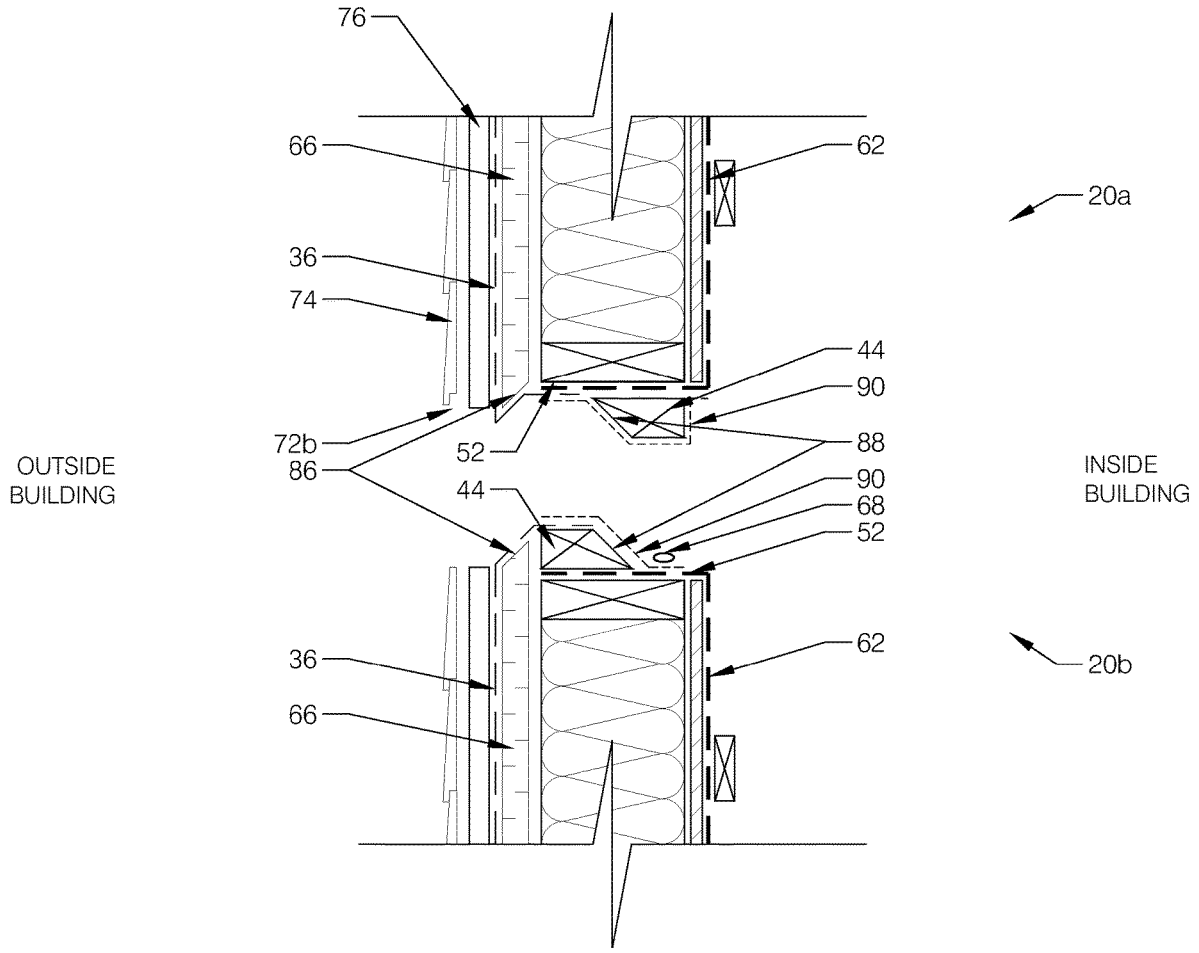
FIG. 2D is a cross-section view, fragmented, of two exterior wall panels configured in a spaced-apart configuration, with rigid heat insulating panels and stud members having beveled edges, according to an embodiment.

Now referring to FIG. 2D, there is shown another embodiment of two exterior wall panels 20 configurable in a vertically-adjacent configuration. It should be understood that the components of the exterior wall panels 20 may have different shapes suitable for abutting against one another to engage and seal the panels together. In this embodiment, the rigid heat insulating panels 66 have beveled edges 86 of complementary shapes to matingly engage when two adjacent exterior wall panels 20 are configured in the adjacent configuration. In the embodiment shown, each beveled edge 86 is covered by the weather barrier membrane 36. A free end of the beveled edges 86 extends downwardly from the outer wall surface 50 to drain water that may accumulate between the exterior wall panels towards the outside of the building. In other words, the beveled edges 86 slope downwardly towards the outside of building so as to drain water that may accumulate between the exterior wall panels 20 towards the outside of the building. Each exterior wall panel 20 includes a horizontal stud member 44 having a beveled face 88 that facilitates mating with a corresponding stud member 44. In the embodiment shown, the vapor barrier membrane 62 covers the peripheral edges 52 but extend between the two vertically-adjacent stud members, i.e. an inner one and the outer one having a beveled face 88. The weather barrier member 36 at least partially covers the peripheral edges 52. The exterior wall panels 20 also comprise a junction barrier member 90 superposed to the stud members 44 defining the peripheral edges 52 and superposed partially to the weather barrier membrane 36 and the vapor barrier membrane 62. This junction barrier member 90 may facilitate the sealing of the exterior wall panels by joining ends of the weather barrier membrane 36 and the vapor barrier membrane 62 that only partially cover the peripheral edges 52. The bonding joint 68 is applied to the junction barrier member 90 of the upper peripheral edge and contacts the junction barrier member of the lower peripheral edge of the adjacent and engaged exterior wall panel 20. The junction barrier member 90 can include a flexible membrane or a substantially rigid panel such as metallic sheets or foil that can also be used as rigid flashing.

Figure 2E:
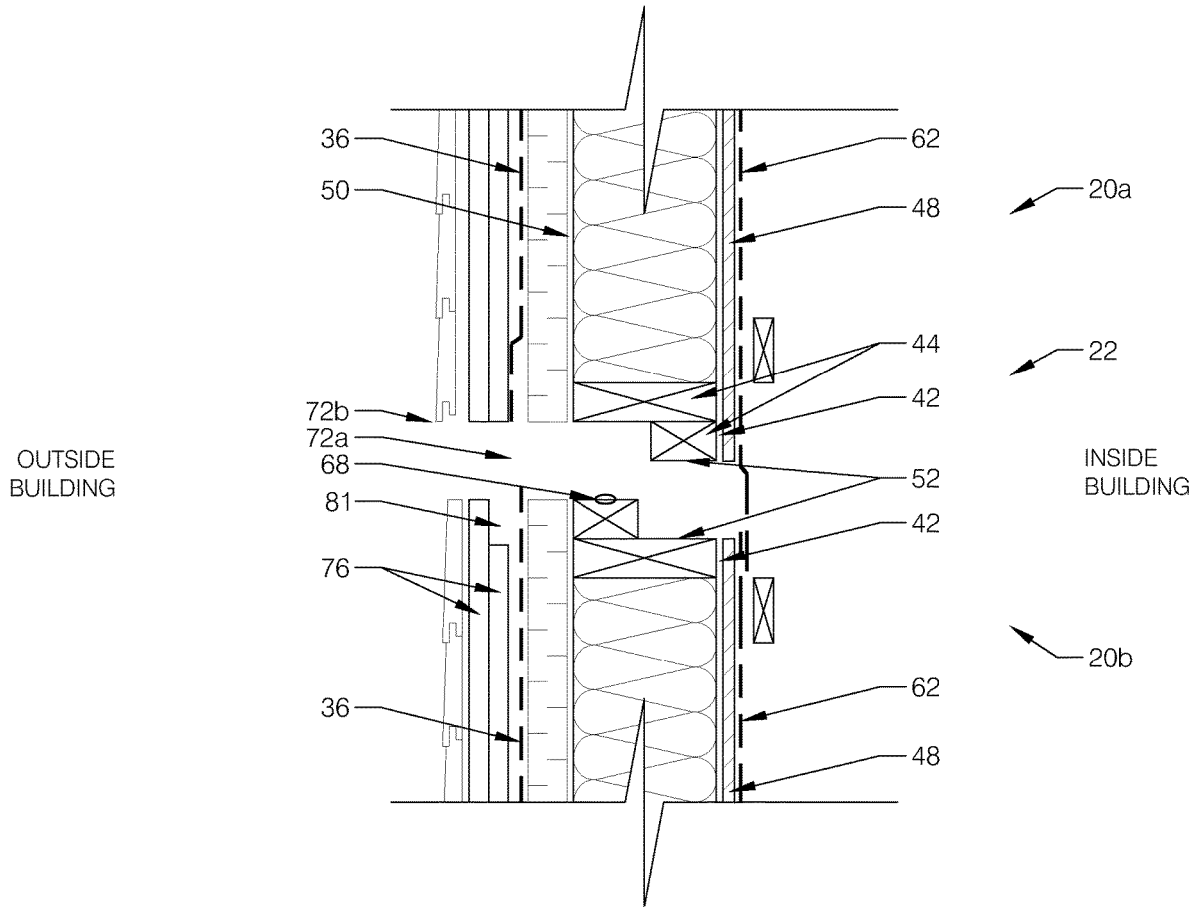
FIG. 2E is a cross-section view, fragmented, of two exterior wall panels configured in a spaced-apart configuration, with the vapor barrier membrane and the weather barrier membrane being respectively superposed to an inner and outer wall surfaces of the exterior wall panels, according to an embodiment, the two exterior wall panels further comprising spaced-apart slats on their outer wall surfaces, the slats forming a plurality of slat layers.

As represented in FIG. 2E, the spaced-apart slats 76 of the exterior wall panel assembly 22 can be configured in a superimposed configuration and form a plurality of slat layers extending between the rigid heat insulating panels 66 and the outer sidings 74. This superimposed configuration of the plurality of spaced-apart slats 76 further increase the stability of the mounting of the outer sidings 74 to the outer wall surface 50, via, in the embodiment shown, the rigid heat insulating panels 66. The upper exterior wall panel 20*a* also comprises two spaced-apart rigid flashings 72*a*, 72*b* configured to at least partially form together the drainage barrier of the exterior wall panel assembly 20. Upper sections of the spaced-apart rigid flashings 72*a*, 72*b* extend respectively—or are superposed to—outer and inner faces of the superimposition of the spaced-apart slats 76. In other words, the upper section of an inner rigid flashing 72*a* extends between the face of the slat layers facing the outer wall surface 50 and the rigid heat insulating panel 66, whereas the upper section of the outer rigid flashing 72*b* extends between the slats 76 (i.e. an outer face of the slat layers) and the outer siding 74.

In the embodiment shown in FIG. 2E, one of the slats 76 extending along the lower exterior wall panel 20*b* has an upper edge offset with regards to an upper edge of another one of the slats 76 extending along the lower exterior wall panel 20*b*. In the embodiment shown, the upper edge of the outer slat 76 extends above the upper edge of the inner slat 76. A panel mating recess 81 is thus formed between the adjacent inner and outer slats 76 extending along the lower exterior wall panel 20*b*. The panel mating recess 81 is dimensioned to receive a section of one of the rigid flashings (of the inner rigid flashing 72*a*, in the non-limitative embodiment shown). In the embodiment shown, the weather barrier membrane 36 of the lower exterior wall panel 20*b* extends between the inner slat 76 and the rigid heat insulating panel 66, and has an upper edge extending slightly above the upper edge of the outer slat 76 (i.e. extending above the upper edge of the inner slat 76).

Even though in the embodiment shown, lower edges of inner and outer slats 76 extending along the upper exterior wall panel 20*a* are substantially aligned with each other, it could be conceived an upper exterior wall panel 20*a* having superimposed slats 76 with lower edges offset from each other. For instance, the superimposed slats 76 of the upper exterior wall panel 20*a* could be offset so as to form a panel mating protrusion (not represented) shaped to be received in the panel mating slot 81 when the upper and lower exterior wall panels 20*a*, 20*b* are configured in an adjacent configuration.

It is appreciated that the shape, the configuration, and the location of the spaced-apart slats 76 and of the slat layers formed thereof can vary from the embodiment shown.

Figure 3A:
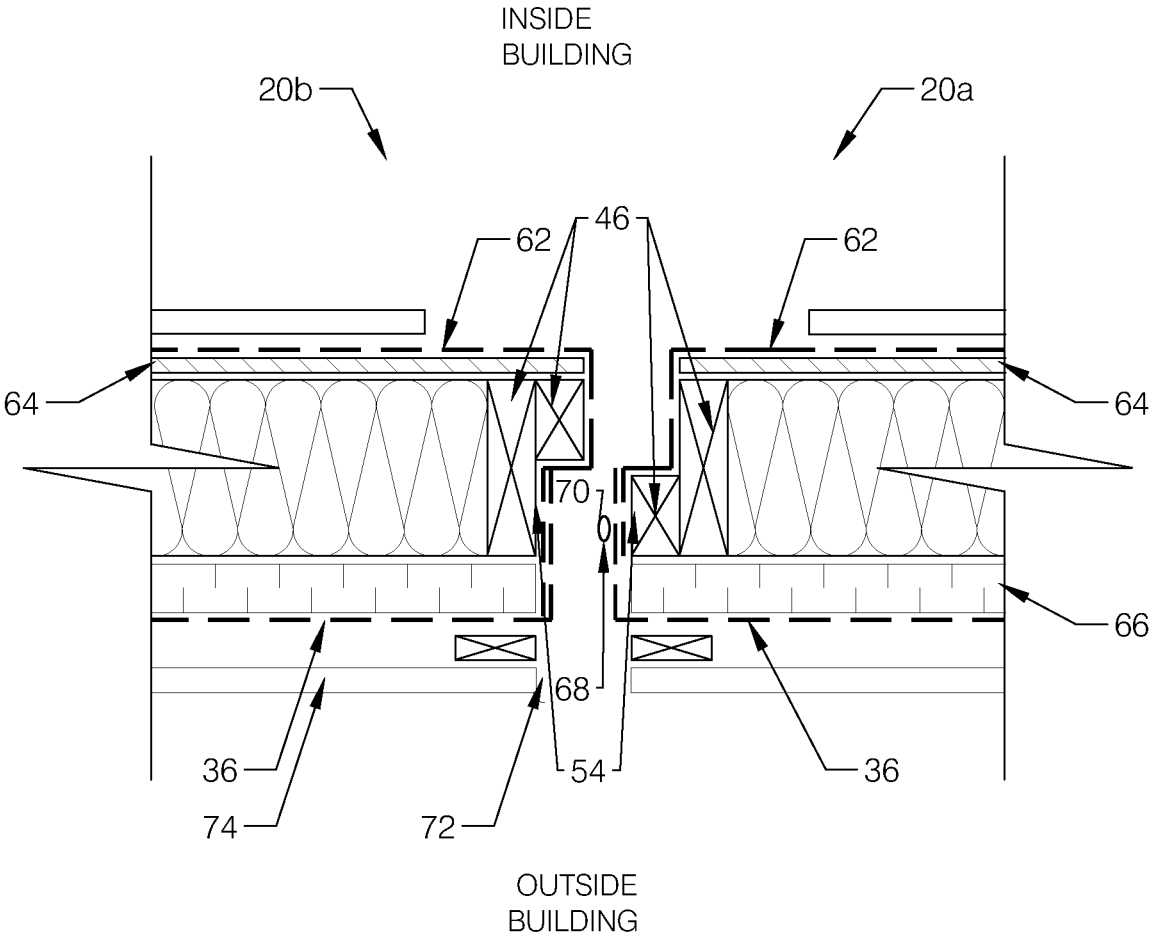
FIG. 3A is a cross-section view, fragmented, of two exterior wall panels configured in a spaced-apart configuration, with the vapor barrier membrane and the weather barrier membrane covering peripheral edges of the exterior wall panels, according to an embodiment.
Figure 3B:
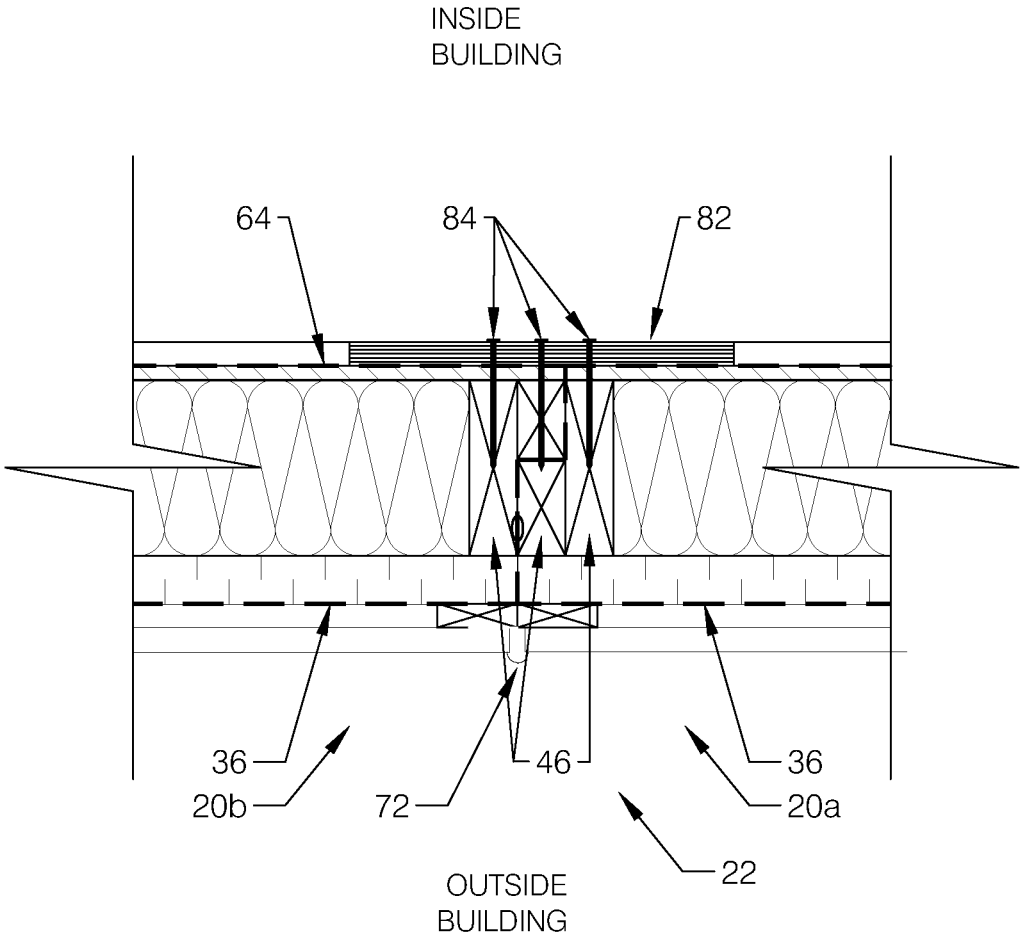
FIG. 3B is a cross-section view, fragmented, of an exterior wall panel assembly, showing the two exterior wall panels of FIG. 3A configured in a horizontally-adjacent configuration.

Referring to FIGS. 3A and 3B, there is shown two exterior wall panels 20 of an exterior wall panel assembly 22 in a horizontally-adjacent configuration. This configuration shows similarities with the embodiment described above in reference to FIGS. 2A and 2B in that each one of the weather barrier membrane 36 and the vapor barrier membrane 62 is at least partially superposed to and covers the peripheral edges 54 with the bonding joint 68 being applied to one of the membranes 36, 62 and contacting another one of the membranes 36, 62 of the adjacent and engaged exterior wall panel 20 to provide a continuous seal inbetween.

More particularly, in the embodiment shown, the bonding joint 68 is applied to the weather barrier membrane 36, that overlaps the vapor barrier membrane 62, of a first exterior wall panel 20*a* and is contacting the weather barrier membrane 36 of a second exterior wall panel 20*b* when in an adjacent configuration as shown on FIG. 3B.

Furthermore, as shown, the structural board 82 is superposed to the structural panel 64 and structural connectors 84 are inserted therethrough to fasten each one of the wall panels 20 to the stud members 46.

Moreover, the second exterior wall panel 20*b* also includes a rigid flashing 72 having a first portion inserted between the outer siding 74 and the weather barrier membrane 36 and a second portion extending perpendicularly to the first portion and outwardly to be superposed against the outer siding 74 of the first exterior wall panel 20*a*, when the first and second exterior wall panels 20*a*, 20*b* are configured in the adjacent configuration, as represented in FIG. 3B.

Figure 4A:
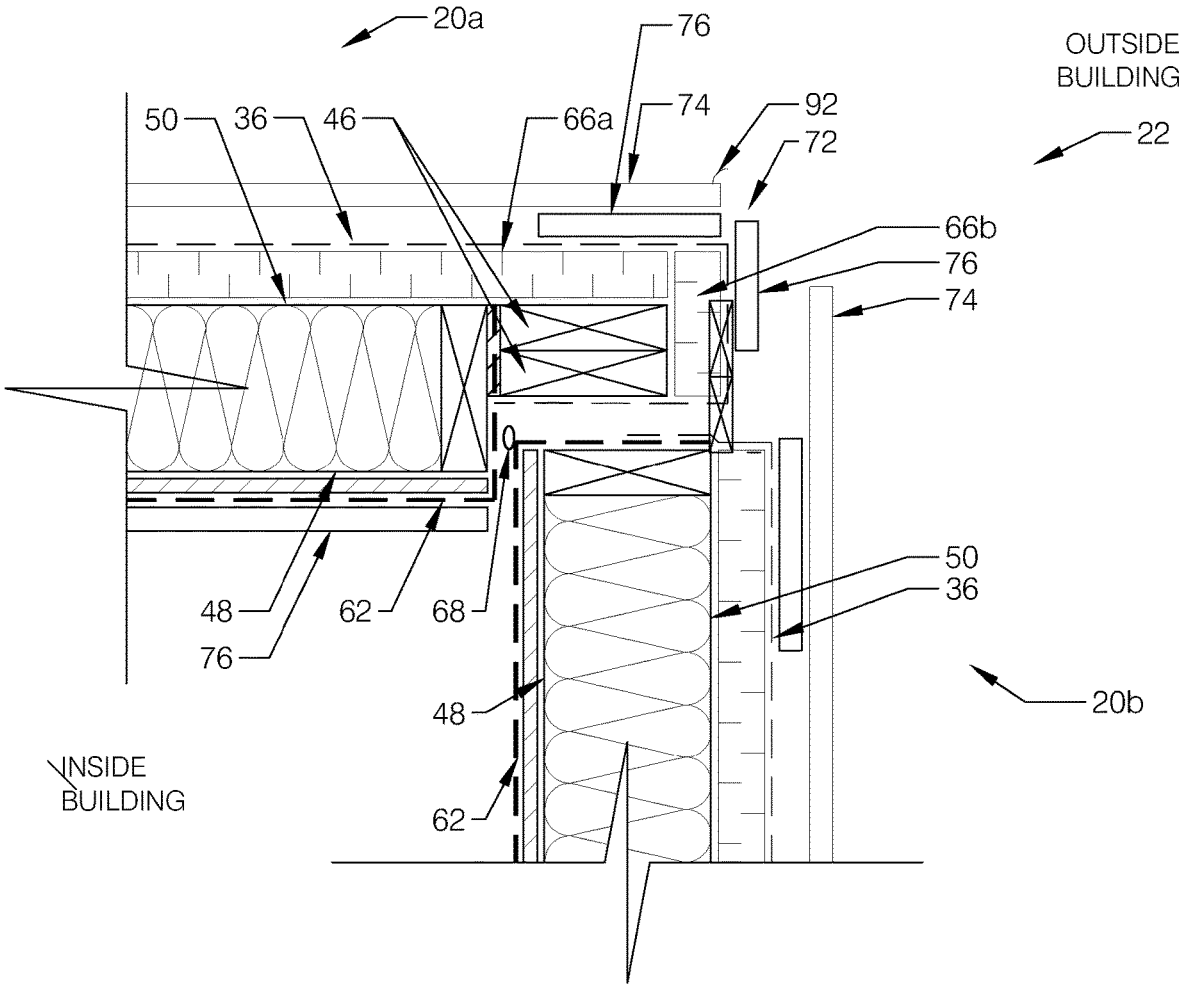
FIG. 4A is a cross-section view, fragmented, of two exterior wall panels configured in a corner configuration and spaced-apart from one another, with the vapor barrier membrane and the weather barrier membrane covering peripheral edges of the exterior wall panels, according to an embodiment.

Now referring to FIG. 4A, there is shown two exterior wall panels 20 configurable in an exterior corner configuration. A first exterior wall panel 20*a* includes two rigid heat insulating panels 66*a*, 66*b*, configured in a perpendicular configuration at an edge of the exterior wall panel 20*a*, to frame the vertical stud members 46. In this embodiment, the weather barrier membrane 36 covers both rigid heat insulating panels 66*a*, 66*b* and a peripheral edge, or side edge, of the stud members 46 extending parallel to the wall surfaces 48, 50. The vapor barrier membrane 62 is also at least partially superposed to and covers the peripheral edges. The bonding joint 68 is applied to one of the membranes 36, 62 and contacting another one of the membranes 36, 62 of the adjacent and engaged exterior wall panel 20 to provide a continuous seal inbetween.

More particularly, in the embodiment shown, the bonding joint 68 is applied to the vapor barrier membrane 62, of the first exterior wall panel 20*a* and is contacting the vapor barrier membrane 62 of the second exterior wall panel 20*b* when in an adjacent configuration.

Two slats 76 frame the rigid heat insulating panels 66*a*, 66*b*, outwardly thereof, and a "X"-shaped rigid flashing 72 is superposed to the two slats 76. More particularly, one arm of the "X"-shaped rigid flashing 72 is inserted between a respective one of the slats 76 and the siding 74 and another one of the arms in inserted between another one of the slats 76 and a respective one of the rigid heat insulating panels 66*b*. The two outer arms of the "X"-shaped rigid flashing 72 protrudes outwardly. In the embodiment shown, the two outer arms of the "X"-shaped rigid flashing 72 extend substantially perpendicularly to each other, but other arrangements could be conceived, so as to modify an outer profile of the exterior wall panel assembly 22. The rigid flashing 72 is shaped as a cross to shield a corner interface formed between the two slats 76 and the ends of two outer siding 74 when the first and second exterior wall panels 20*a*, 20*b* are placed in the adjacent and engaged configuration. A sealing material 92 is added at a seam between the outer siding 74 and the two outwardly-protruding arms of the rigid flashing 72 of the first exterior wall panel 20*a*. The exterior wall panel assembly 22 includes a slat 76 superposed to the inner wall surface 48 of the first wall panel 20*a* that may act, with a structural corner element 94 (see FIG. 4C), as a support for fastening therethrough to secure the first and second exterior wall panels 20*a*, 20*b* together.

Figure 4B:
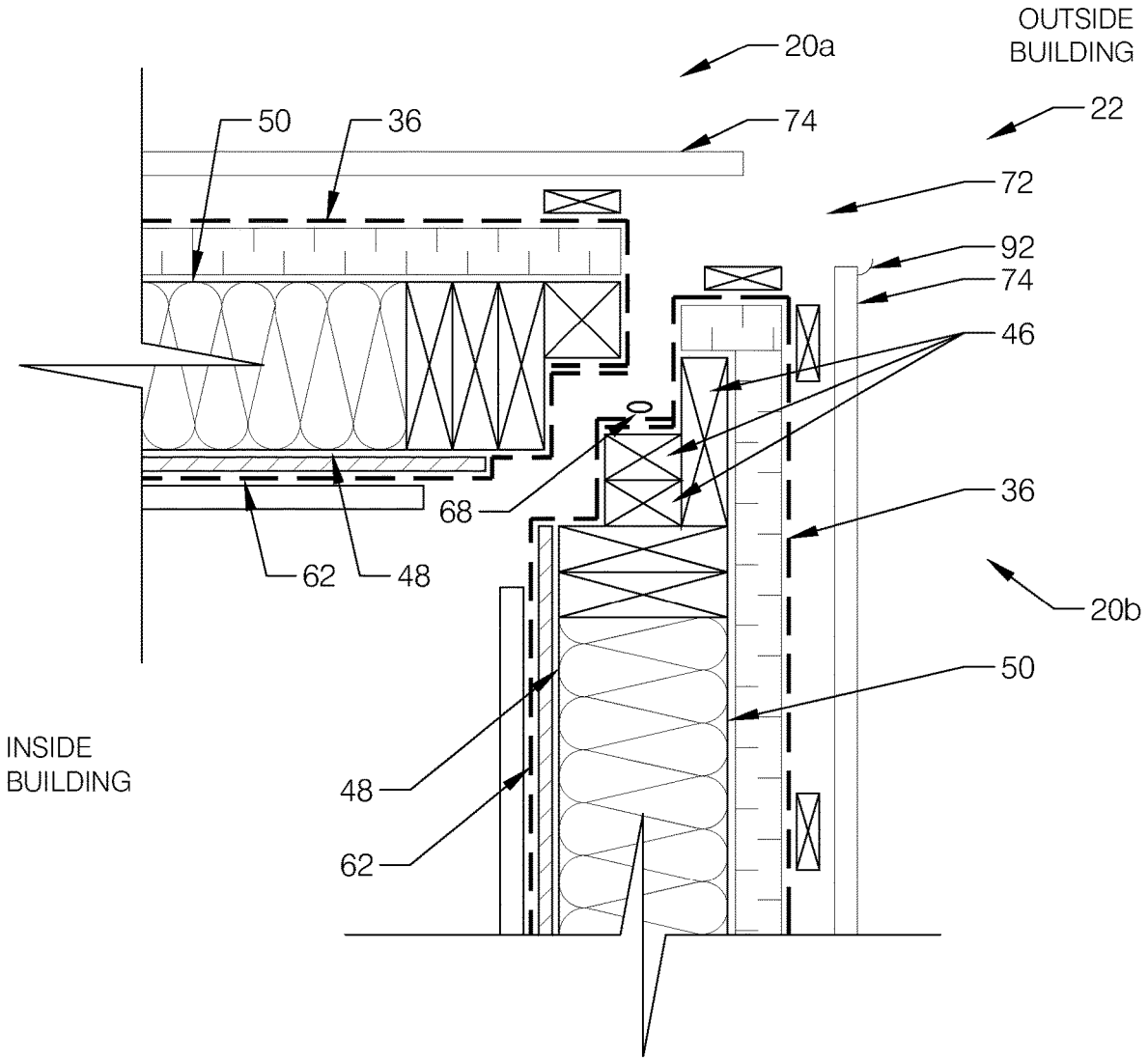
FIG. 4B is a cross-section view, fragmented, of two exterior wall panels configured in a corner configuration and spaced-apart from one another, with the vapor barrier membrane and the weather barrier membrane partially covering peripheral edges of the exterior wall panels, according to another embodiment.
Figure 4C:
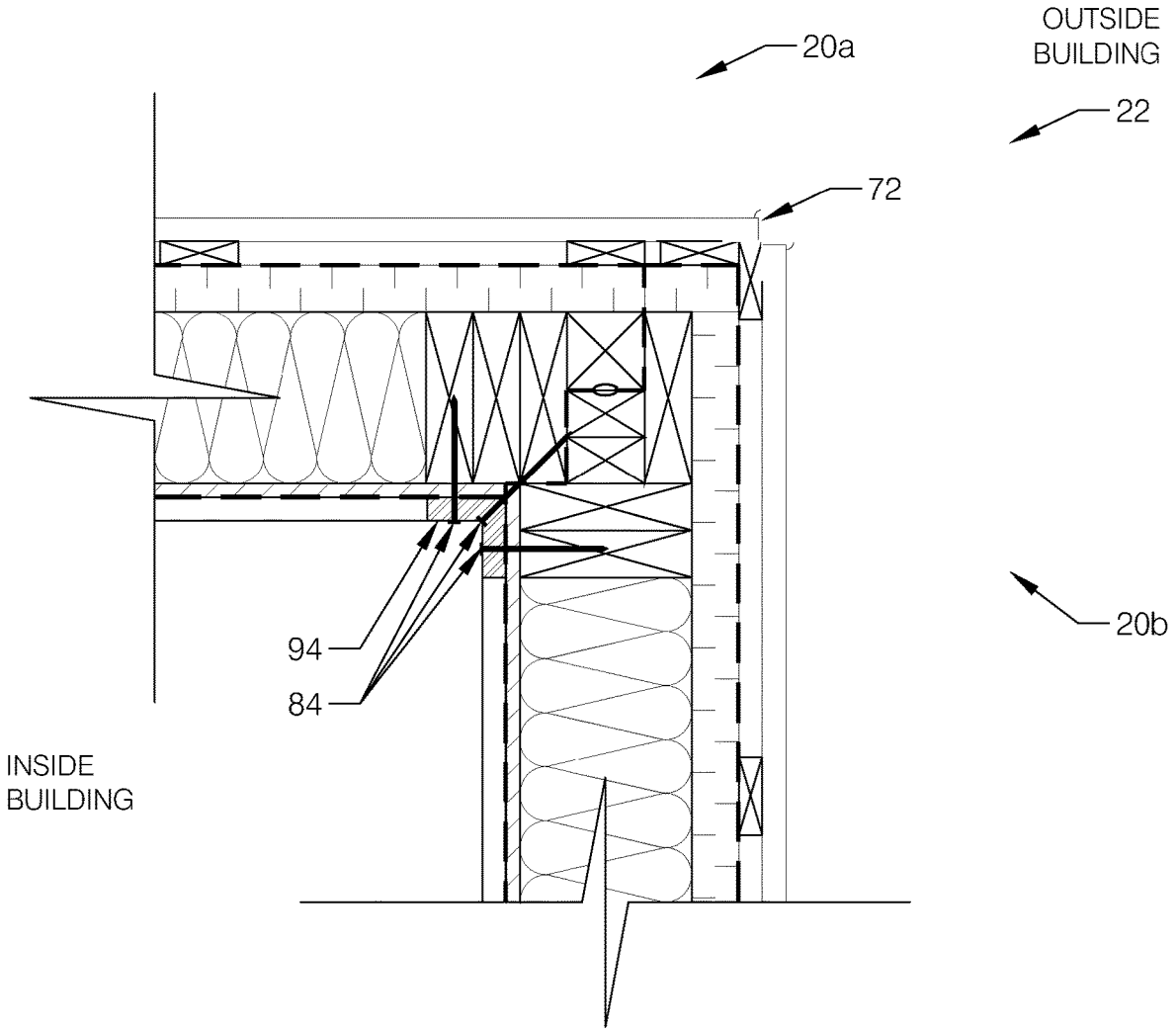
FIG. 4C is a cross-section view, fragmented, of an exterior wall panel assembly, showing the two exterior wall panels of FIG. 4B adjacent to one another to define an exterior corner.

Referring to FIGS. 4B and 4C, there is shown two exterior wall panels 20 and an exterior wall panel assembly 22 in another exterior corner configuration. The wall panels 20 differ from the wall panels depicted on FIG. 4A as having different sizes of stud members 46 and configuration thereof. The side peripheral edges 54 of the exterior wall panels have a staircase-like profile. The exterior wall panel assembly 22 comprises a "X"-shaped rigid flashing 72 that is placed at the junction of the outer sidings 74. FIG. 4C shows the exterior wall panels 20 in an exterior corner configuration with the structural corner element 94 and structural connectors 84 securing the wall panels 20 together.

Figure 5A:
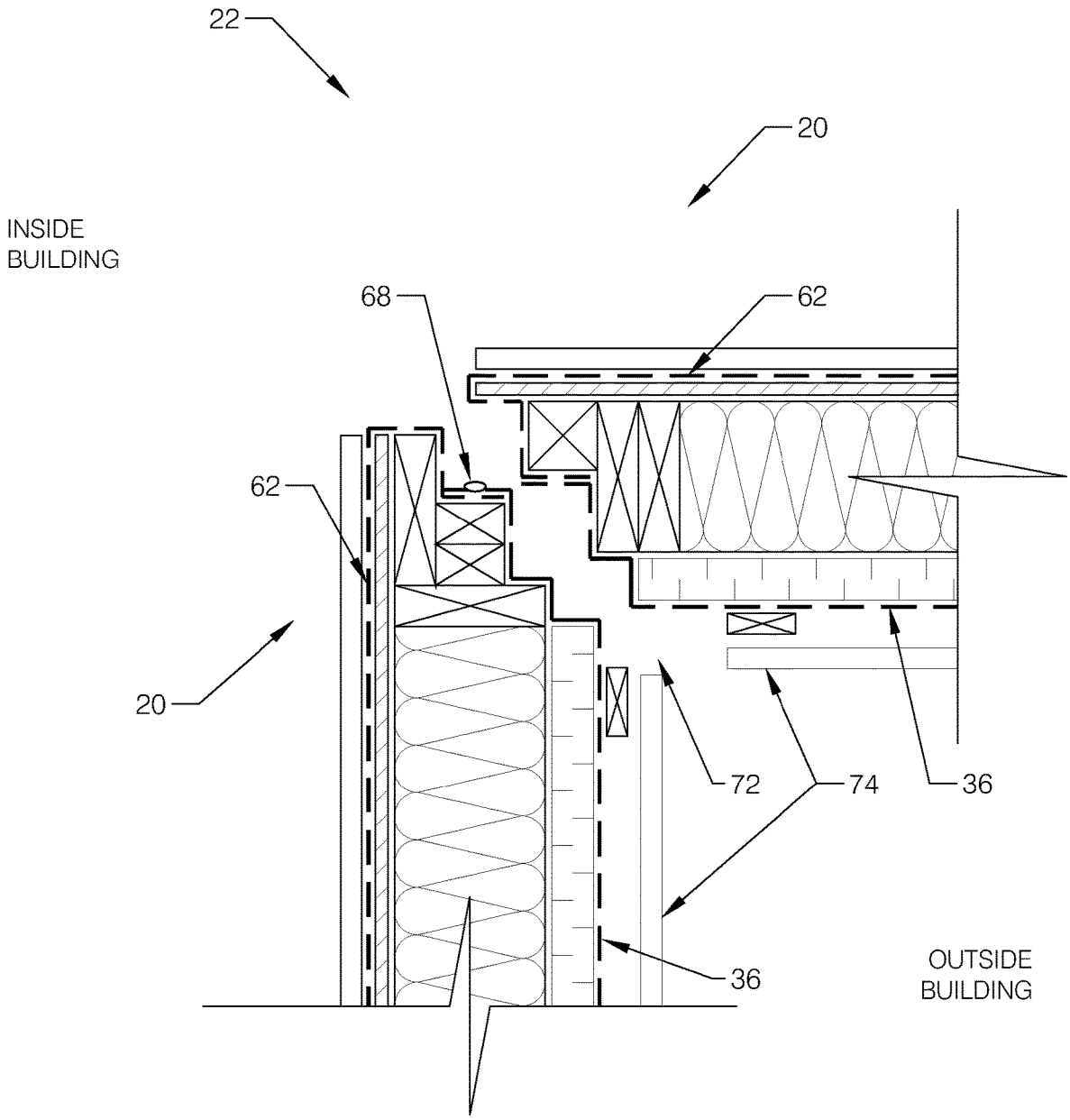
FIG. 5A is a cross-section view, fragmented, of two exterior wall panels configured in a corner configuration and spaced-apart from each other, with the vapor barrier membrane and the weather barrier membrane covering peripheral edges of the exterior wall panels, according to an embodiment.
Figure 5B:
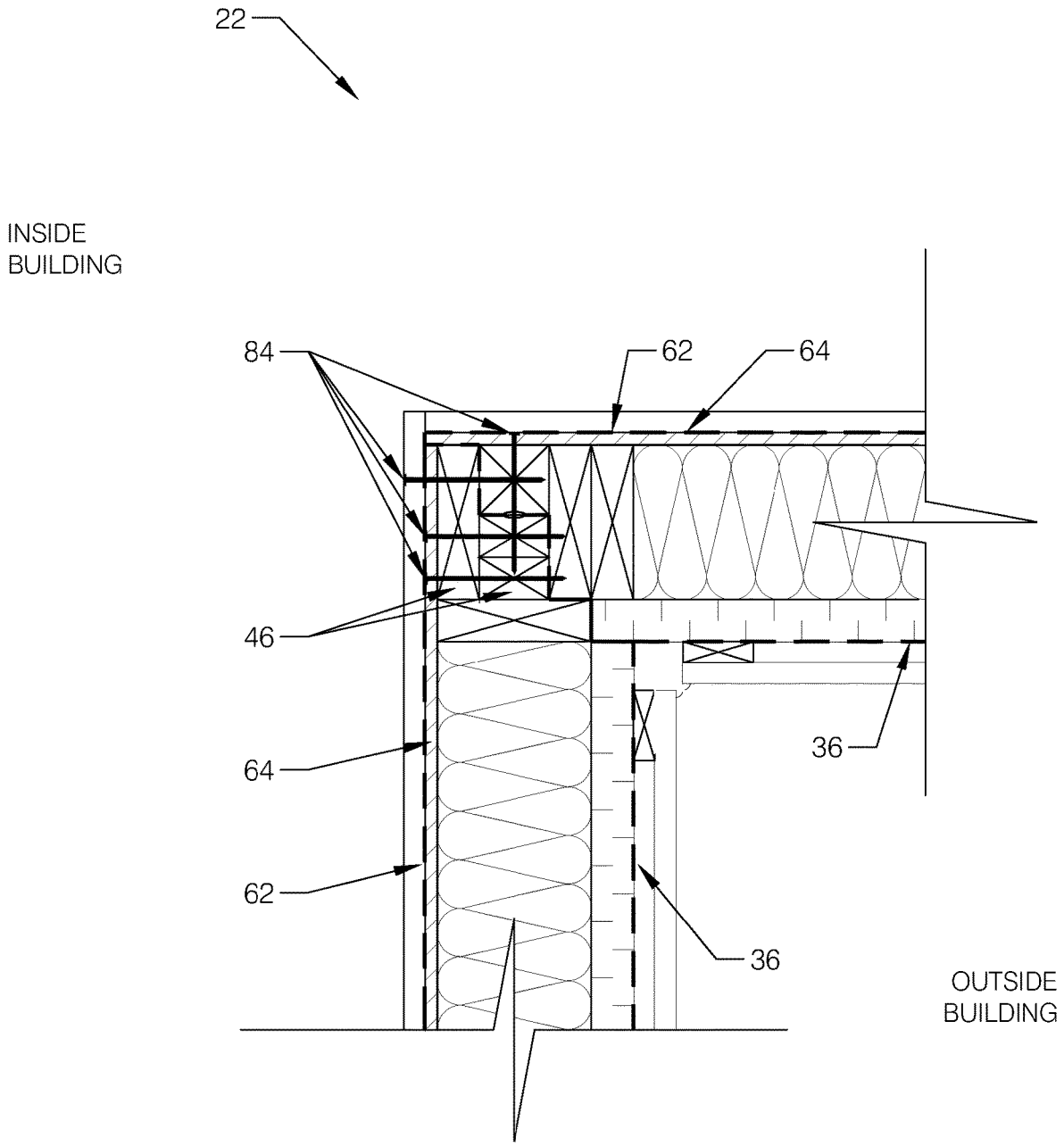
FIG. 5B is a cross-section view, fragmented, of an exterior wall panel assembly, showing the two exterior wall panels of FIG. 5A adjacent to one another to define an interior corner.

Referring now to FIGS. 5A and 5B, there is shown two exterior wall panels 20 and an exterior wall panel assembly 22 in an interior corner configuration with structural connectors 84 for fastening the structural panels 64 to the stud members 46, thus securing the wall panels together.

As the embodiments described above, the vapor barrier membrane 62 and the weather barrier membrane 36 are also at least partially superposed to and cover the peripheral edges. The bonding joint 68 is applied to one of the membranes 36, 62 and contacting another one of the membranes 36, 62 of the adjacent and engaged exterior wall panel 20 to provide a continuous seal inbetween.

A rigid flashing 72 defining an acute angle is provided at the external junction of the two adjacent and engaged exterior wall panels 20.

Figure 6A:
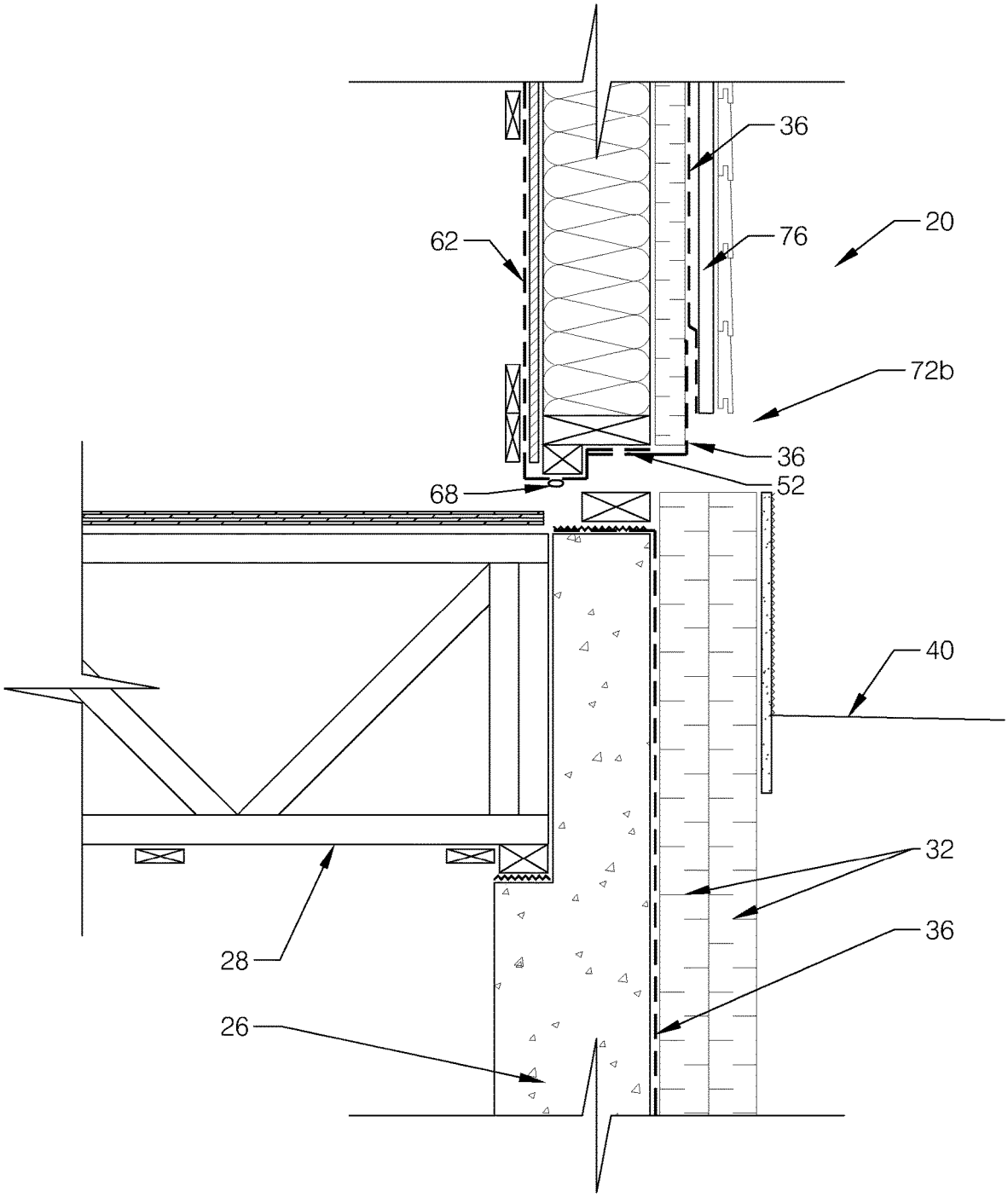
FIG. 6A is a cross-section view, fragmented, of a configuration including an exterior wall panel, a foundation wall and a floor truss according to an embodiment.

Referring to FIG. 6A, there is shown an exterior wall panel 20 to be mounted in a vertically-adjacent configuration to a foundation wall 26 onto which a floor truss 28 abuts. The foundation wall 26 is made of concrete and is covered on an outer side by a weather barrier membrane 36. As shown, two rigid heat insulating panels 32, larger in size than the heat insulating panels included in the exterior wall panel assemblies 22, are superposed to the foundation wall 26 and weather barrier membrane 36, outwardly thereof, and with the ground cable 40 extending outwardly and along a portion of the outer heat insulating panel. The exterior wall panel 20 comprises the rigid flashing 72*b* designed to cover the top edges of the heat insulating panels 32 and shield the joint between the wall panel 20 and the foundation wall 26. A first section of the rigid flashing 72*b* extends between two weather barrier membranes having sections superposed to one another in a lower portion of the exterior wall panel 20.

The lower peripheral edge 52 of the exterior wall panel 20 is covered by a combination of the weather barrier membrane 36 and the vapor barrier membrane 62 which have a section thereof superposed to one another along the lower peripheral edge 52. The bonding joint 68 is applied to the vapor barrier membrane 62 and contacts a membrane applied to an upper edge of the foundation wall 26 when superposed thereto. It is appreciated that, in an alternative embodiment (not shown), the bonding joint 68 can be applied to the weather barrier membrane 36.

Figure 6B:
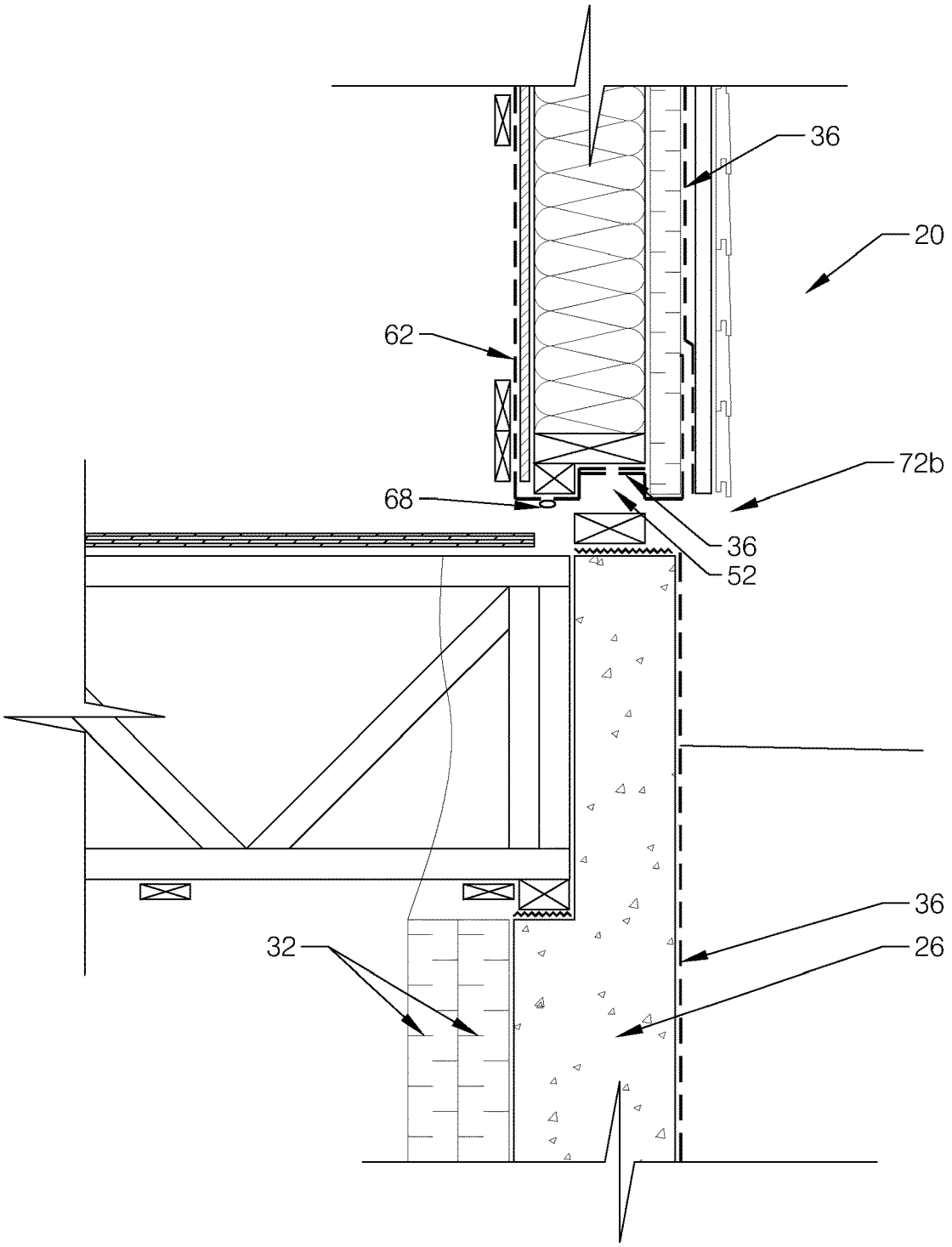
FIG. 6B is a cross-section view, fragmented, of a configuration including an exterior wall panel, a foundation wall and a floor truss according to another embodiment.

Referring to FIG. 6B, the embodiment depicted differs from the one of FIG. 6A in that the rigid heat insulating panels 32 are placed on the inner side of the foundation wall 26 and therefore the rigid flashing 72*b* is sized to be superposed solely to the outer side of the foundation wall 26.

Furthermore, in the embodiment shown in FIG. 6B, as in FIG. 6A, the lower peripheral edge 52 of the exterior wall panel 20 is covered by a combination of the weather barrier membrane 36 and the vapor barrier membrane 62 which have a section thereof superposed to one another along the lower peripheral edge 52. The bonding joint 68 is applied to the vapor barrier membrane 62 but contacts an upper edge of the floor truss 28 when the exterior wall panel 20 is superposed to the upper edge of the foundation wall 26.

Figure 6C:
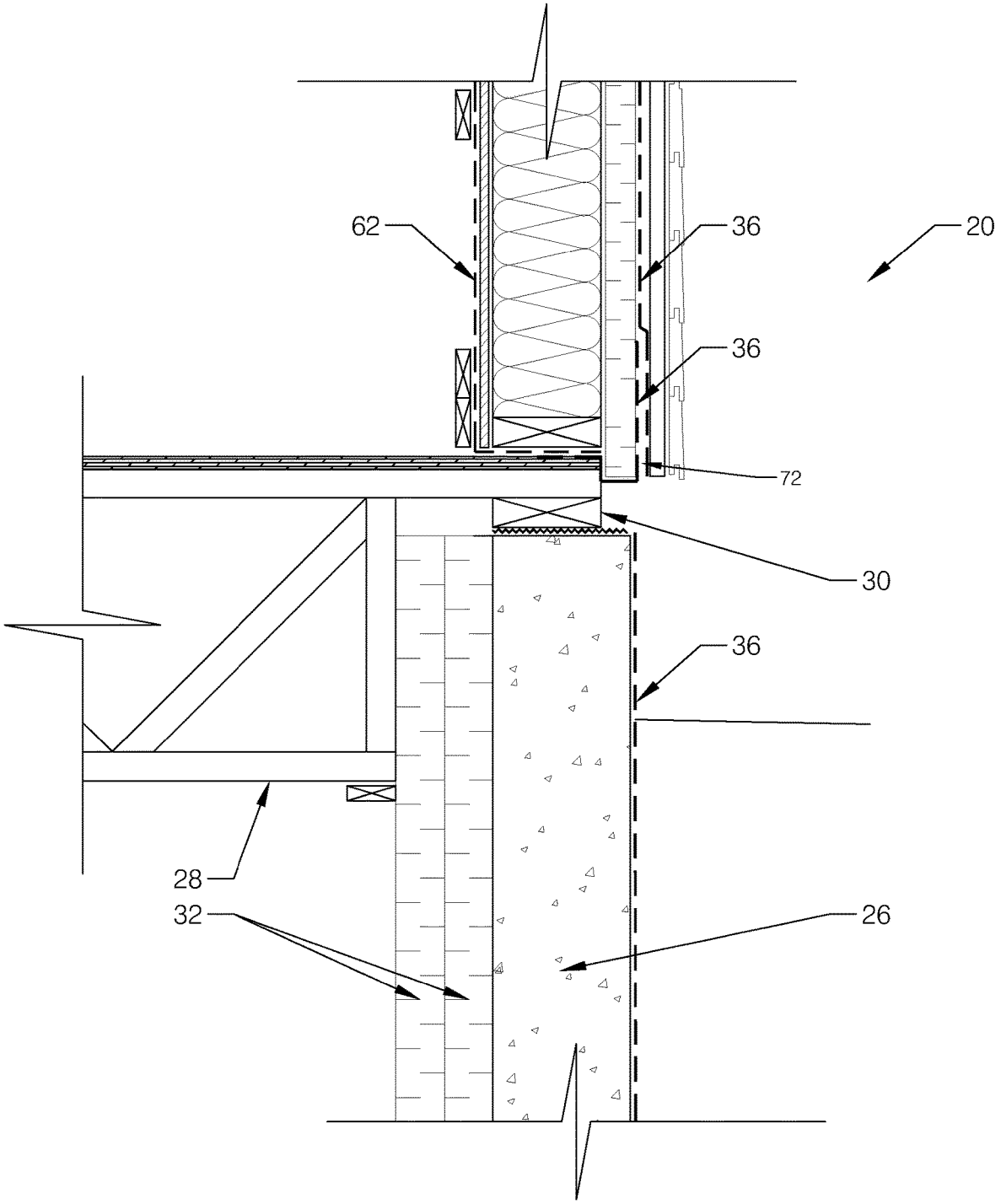
FIG. 6C is a cross-section view, fragmented, of an exterior wall panel adjacent to a foundation wall and a floor truss according to still another embodiment.

Now referring to FIG. 6C, there is shown an embodiment similar to that of FIG. 6B but showing the rigid heat insulating panels 32 covering the height of the foundation wall 26 and the floor truss 28 being mounted between the exterior wall panel 20 and a stud member 30 abutting against the foundation wall 26.

As in the embodiment shown in FIG. 6B, the lower peripheral edge 52 of the exterior wall panel 20 is covered by a combination of the weather barrier membrane 36 and the vapor barrier membrane 62 which have a section thereof superposed to one another along the lower peripheral edge 52. The bonding joint 68 is applied to the vapor barrier membrane 62 and contacts an upper edge of the floor truss 28 when the exterior wall panel 20 is superposed to the upper edge of the foundation wall 26.

Figure 6D:
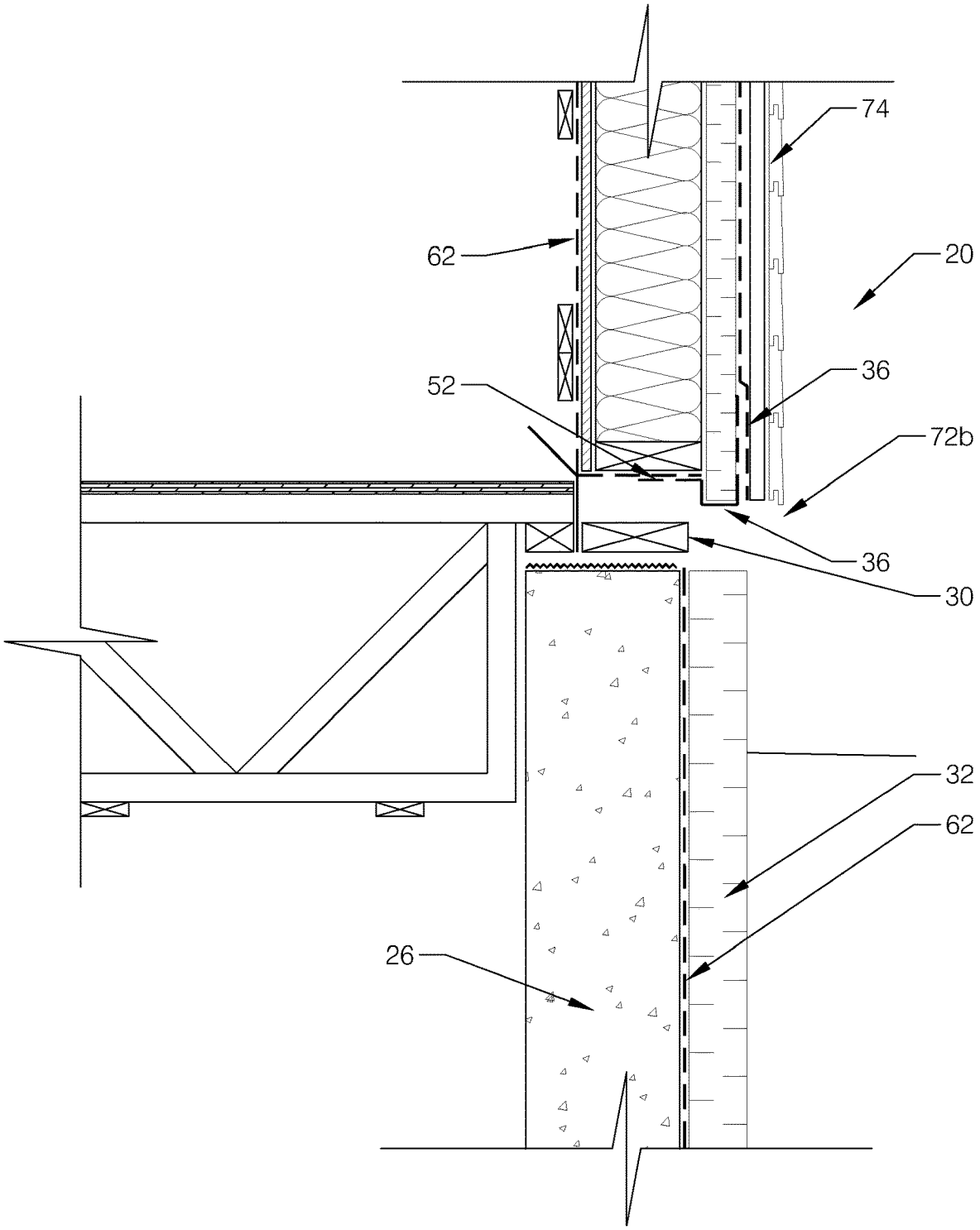
FIG. 6D is a cross-section view, fragmented, of a configuration including an exterior wall panel, a foundation wall and a floor truss according to a further embodiment.

FIG. 6D shows an embodiment of the exterior wall panel 20 similar to that of FIG. 6C to be mounted to a foundation wall 26 onto which are superposed, on an outer side, a vapor barrier membrane 62 and a rigid heat insulating panel 32. In this embodiment, the exterior wall panel 20 abuts against a stud member 30 and the rigid flashing 72*b* provides a seal/shield between the wall panel 20 and the rigid heat insulating panel 32.

As in the embodiments shown in FIGS. 6A, 6B, and 6C, the lower peripheral edge 52 of the exterior wall panel 20 is covered by a combination of the weather barrier membrane 36 and the vapor barrier membrane 62 which have a section thereof superposed to one another along the lower peripheral edge 52. However, no bonding joint 68 is applied. It is however appreciated that, in an alternative embodiment, the exterior wall panel can be provided with a bonding joint applied to one of the vapor barrier membrane 62 and the weather barrier membrane 36 to contact an upper edge of the stud member 30 and/or the upper edge of the foundation wall 26.

Moreover, in the embodiments shown in FIGS. 6A, 6B, 6C and 6D, a combination of two weather barrier membranes 36 covers a lower portion of the outer wall surface 50 of the exterior wall panel 20, for an upper portion of the rigid flashing 72*b* to be sandwiched between the two weather barrier membranes 36. A first one of the combination of the weather barrier membranes 36 has a lower edge substantially aligned with a lower edge of the slat 76, whereas a second one of the combination of the weather barrier membranes 36 has an upper edge located between the heat insulating panel 32 and the slat 76 of the exterior wall panel 20. The lower peripheral edge 52 of the exterior wall panel 20 is covered by a combination of the second one of the combination of the weather barrier membranes 36 and the vapor barrier membrane 62 which have a section thereof superposed to one another along the lower peripheral edge 52.

Figure 7A:
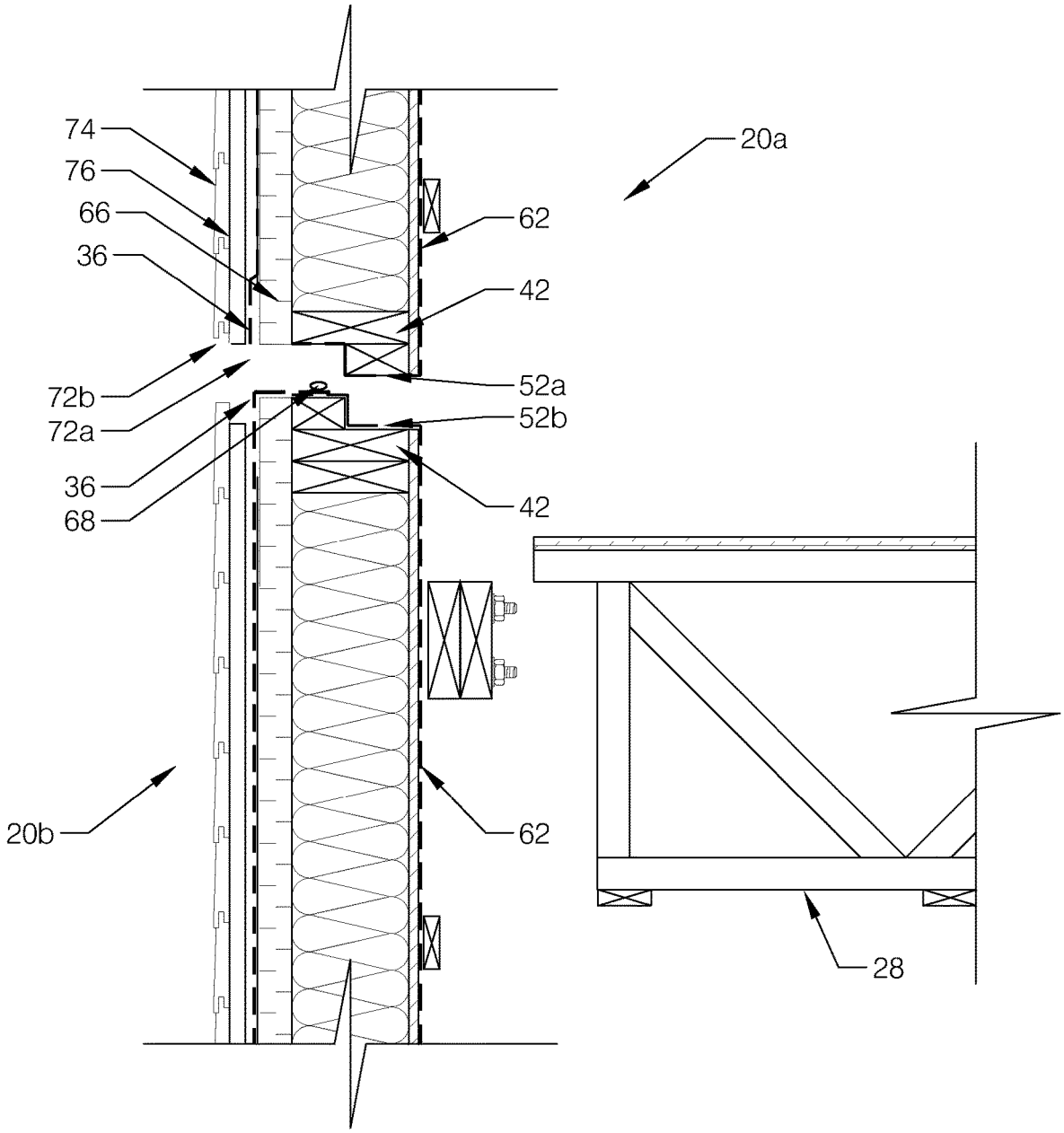
FIG. 7A is a cross-section view, fragmented, of two exterior wall panels configured in a spaced-apart configuration and a floor truss configured to be mounted to one of the two exterior wall panels according to an embodiment.
Figure 7B:
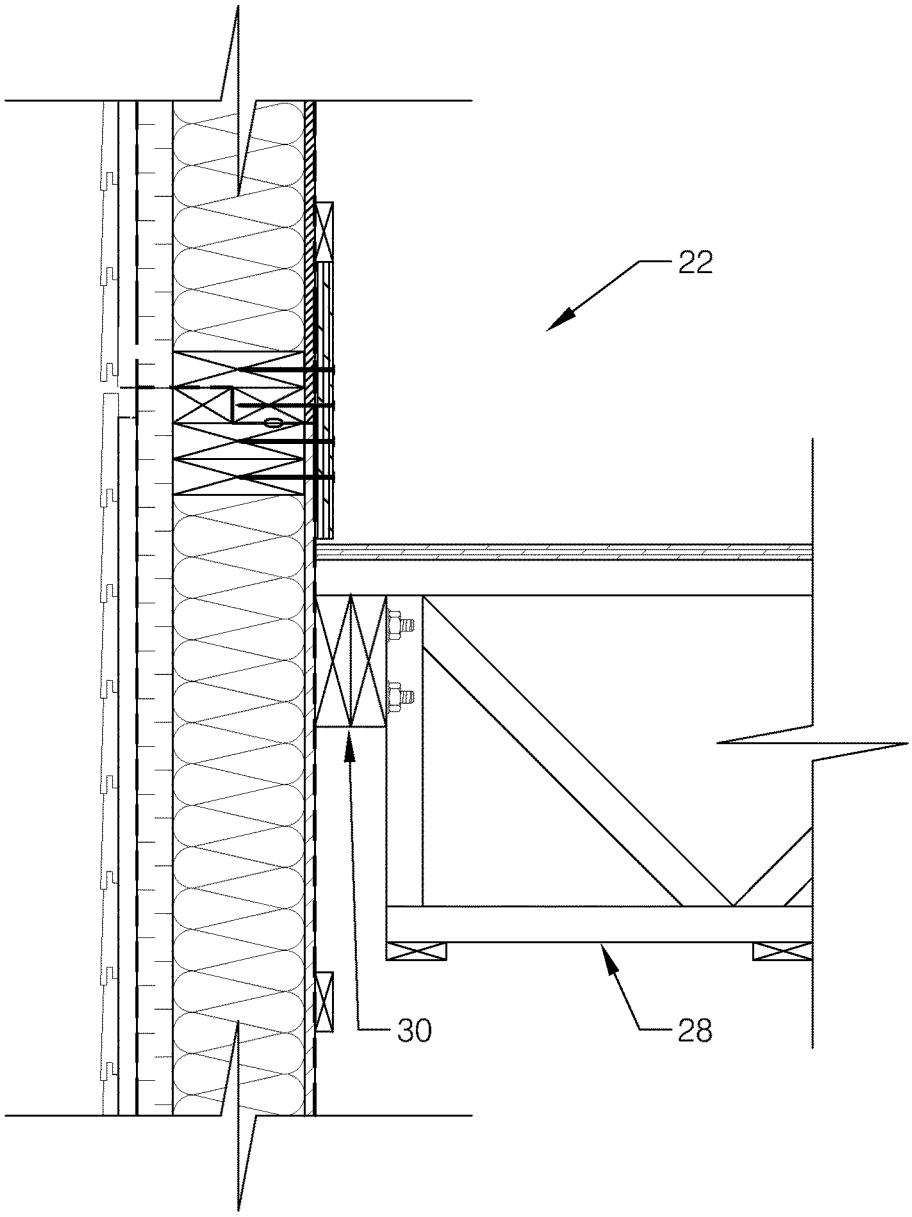
FIG. 7B is a cross-section view, fragmented, of an exterior wall panel assembly showing the two exterior wall panels of FIG. 7A configured in a vertically-adjacent configuration and a floor truss mounted to horizontal studs secured to the exterior wall panel assembly.

FIG. 7A shows an embodiment similar to that of FIG. 2A with the vapor barrier membrane 62 covering an upper and a lower peripheral edges 52*a*, 52*b* of the wall framework 42 and the weather barrier membrane 36 partially covering the upper peripheral edge 52*a*. A first rigid flashing 72*a* has a first section superposed and secured to the rigid heat insulating panel 66 of the upper exterior wall panel 20*a* (i.e. extending between the rigid heat insulating panel 66 and the weather barrier membrane 36 of the upper exterior wall panel 20*a*) and a second section extending downwardly past the lower peripheral edge of the upper exterior wall panel 20*a*. The second section is superposable outwardly to the weather barrier membrane 36 of a lower one 20*b* of the exterior wall panels 20 to seal the two wall panels 20 at their junction and shield the joint inbetween. A second rigid flashing 72*b* is provided between the outer siding 74 and the slat 76 with a section protruding outwardly and superposed to a lower edge of the outer siding 74. In this embodiment, the bonding joint 68 is applied to the weather barrier membrane 36 of the lower exterior wall panel 20*b* and contacts the vapor barrier membrane 62 of the upper exterior wall panel 20*a*. FIG. 7A also shows a floor truss 28 to be mounted to the wall panel assembly 22 of FIG. 7B, by abutting onto stud members 30 secured to the lower exterior wall panel 20*b*, inwardly thereof.

Figure 7C:
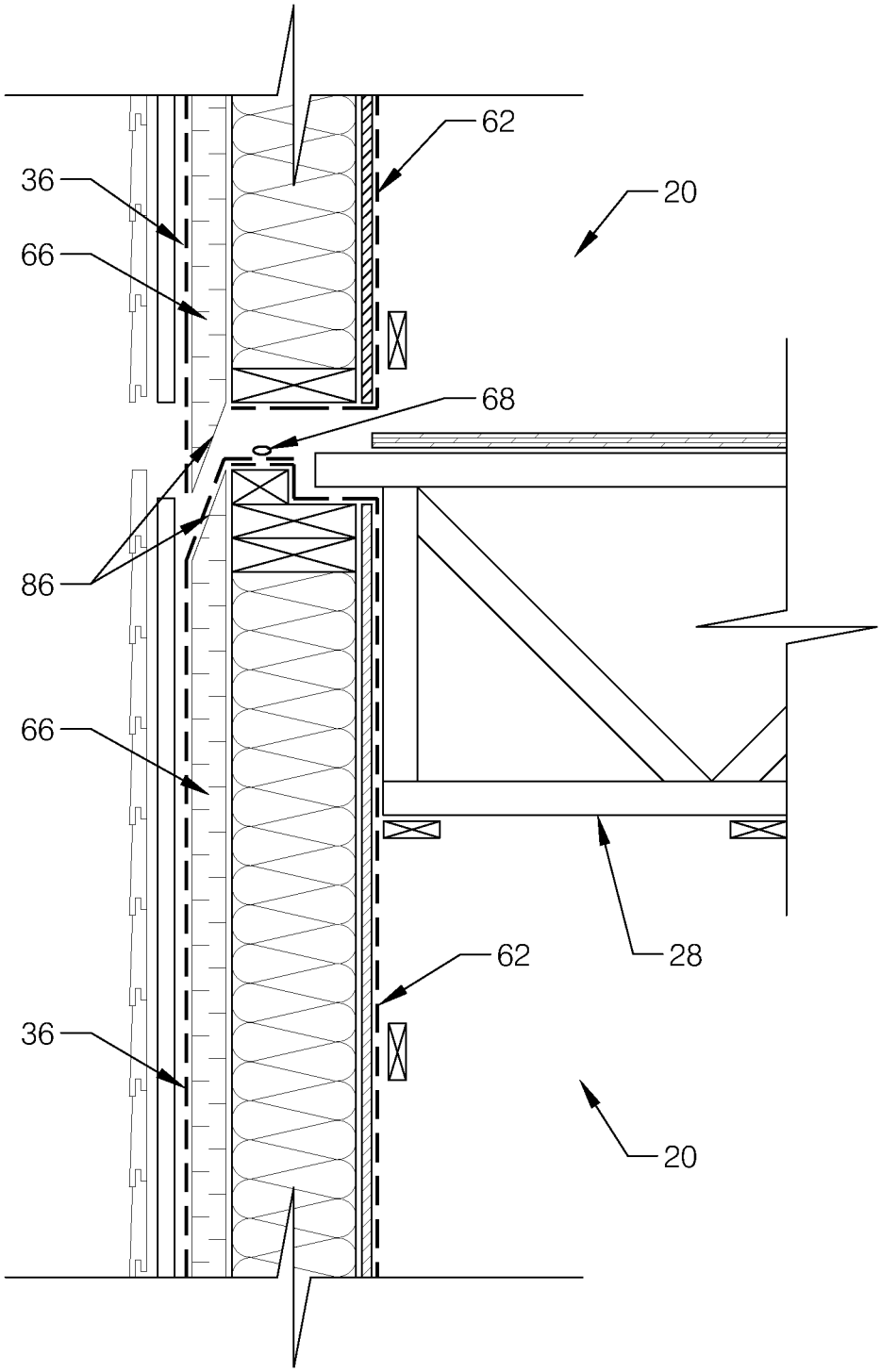
FIG. 7C is a cross-section view, fragmented, of two exterior wall panels configured in a spaced-apart configuration with rigid heat insulating panels having beveled edges and a floor truss engageable therewith according to an embodiment.

Referring to FIG. 7C, there is shown an alternative embodiment of the exterior wall assembly 20 wherein the rigid heat insulating panels 66 have upper and lower beveled edges 86 for matingly engaging when in an adjacent configuration. In this embodiment, a floor truss 28 is mounted to and has a section extending between the exterior wall panels 20 in the adjacent and engaged configuration.

Figure 7D:
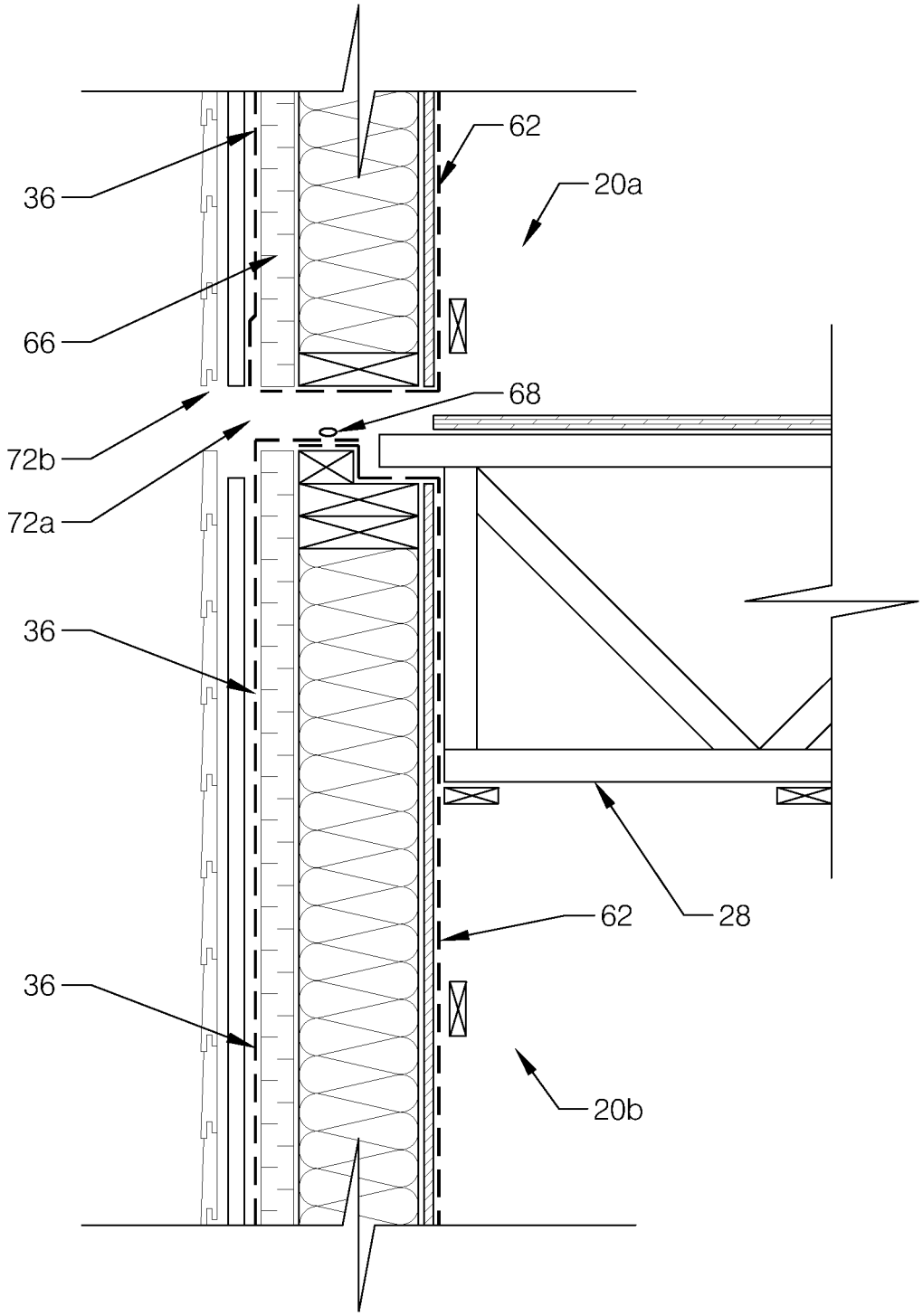
FIG. 7D is a cross-section view, fragmented, of two exterior wall panels configured in a spaced-apart configuration and a floor truss engageable therewith according to an embodiment.
Figure 7E:
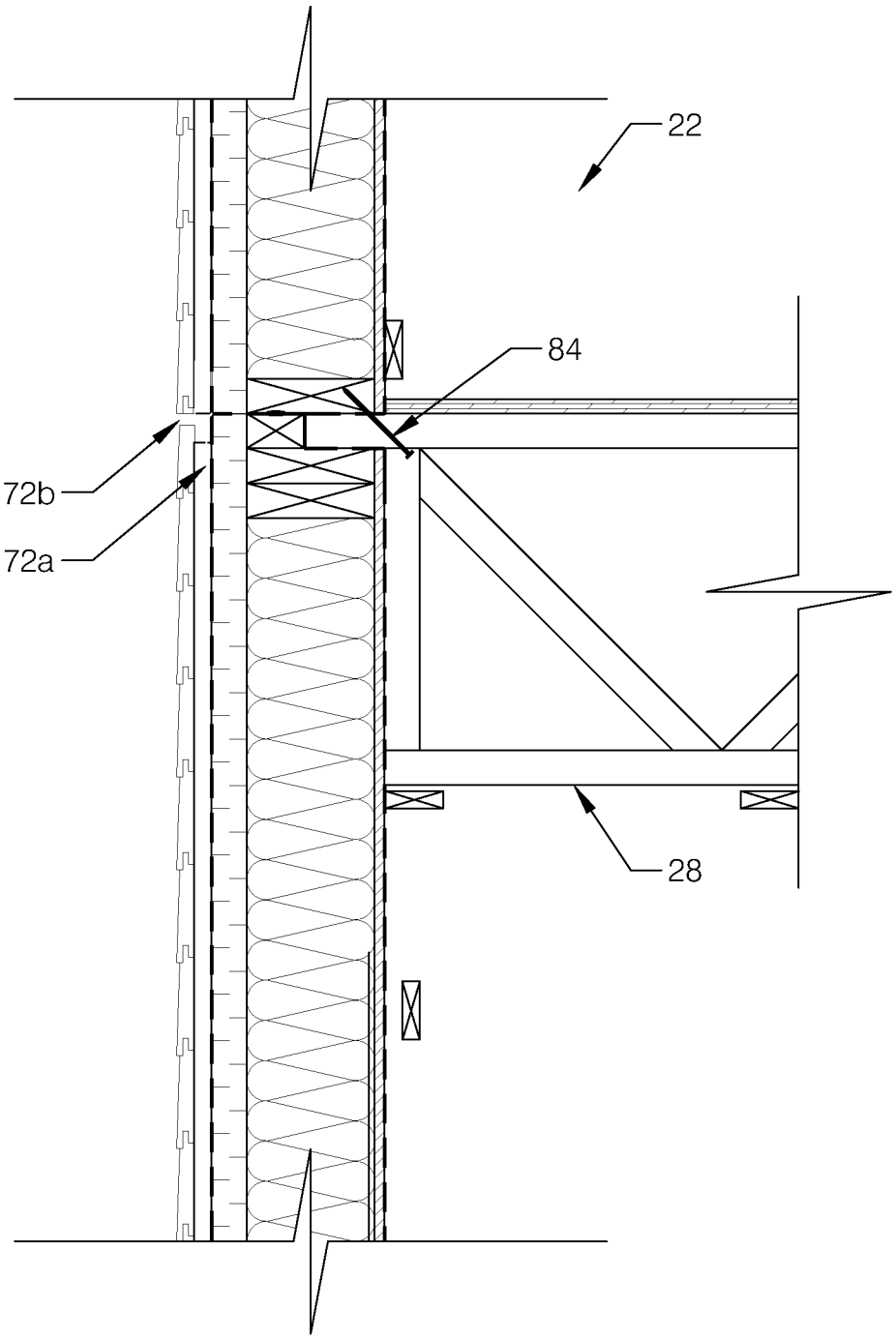
FIG. 7E is a cross-section view, fragmented, of an exterior wall panel assembly showing the two exterior wall panels of FIG. 7D configured in a vertically-adjacent configuration and a floor truss having an end portion engaged between the exterior wall panels.

FIGS. 7D and 7E show an alternative embodiment of the exterior wall panels 20 of FIG. 7C wherein, instead of the beveled edges of the rigid heat insulating panels 66, the upper exterior wall panel 20*a* is provided with a rigid flashing 72*a* having a first section superposed and secured to the rigid heat insulating panel 66 of the upper exterior wall panel 20*a* and a second section extending downwardly past the lower peripheral edge of the upper exterior wall panel 20*a*. The second section is superposable outwardly to the weather barrier membrane 36 of a lower one 20*b* of the exterior wall panels 20 to seal the two wall panels 20 at their junction and shield the joint inbetween. On FIG. 7E, the floor truss 28 is secured to the wall panel assembly 22 with a structural connector 84. An exterior wall panel assembly 22 comprising exterior wall panels 20 having heat insulating panels 66 with beveled edges, as represented in FIG. 7C, and a rigid flashing 72*a* superposed and secured to the rigid heat insulating panel 66, as represented in FIGS. 7D and 7E, could also be conceived, as represented for instance in FIG. 2F.

Figure 2F:
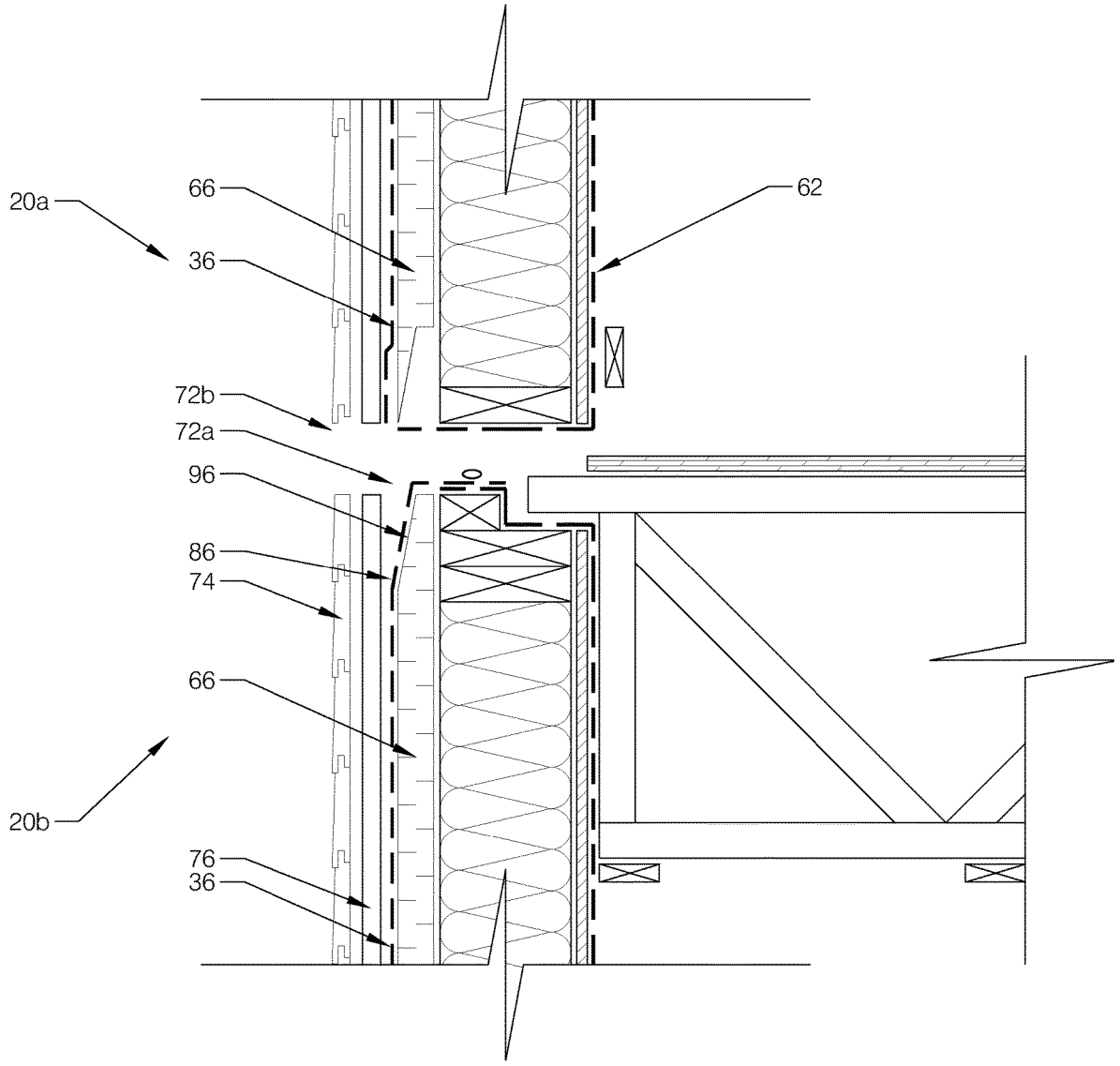
FIG. 2F is a cross-section view, fragmented, of two exterior wall panels configured in a spaced-apart configuration with rigid heat insulating panels having beveled edges and a floor truss engageable therewith according to an embodiment, one of the exterior wall panels further comprising a rigid flashing receivable between slats and a weather barrier membrane of the other one of the exterior wall panels.

Moreover, as represented in FIG. 2F, upper edges of the slats 76, the outer siding 74 and the rigid heat insulating panel 66 of the lower exterior wall panel 20*b* are substantially aligned with each other, so as to contribute to the stability of the mounting of the outer sidings 74 to the outer wall surface 50, via, in the embodiment shown, the rigid heat insulating panels 66 and the slats 76. Similarly, in the embodiment shown, lower edges of the slats 76, the outer siding 74 and the rigid heat insulating panel 66 of the upper exterior wall panel 20*a* are substantially aligned with each other.

Figure 7F:
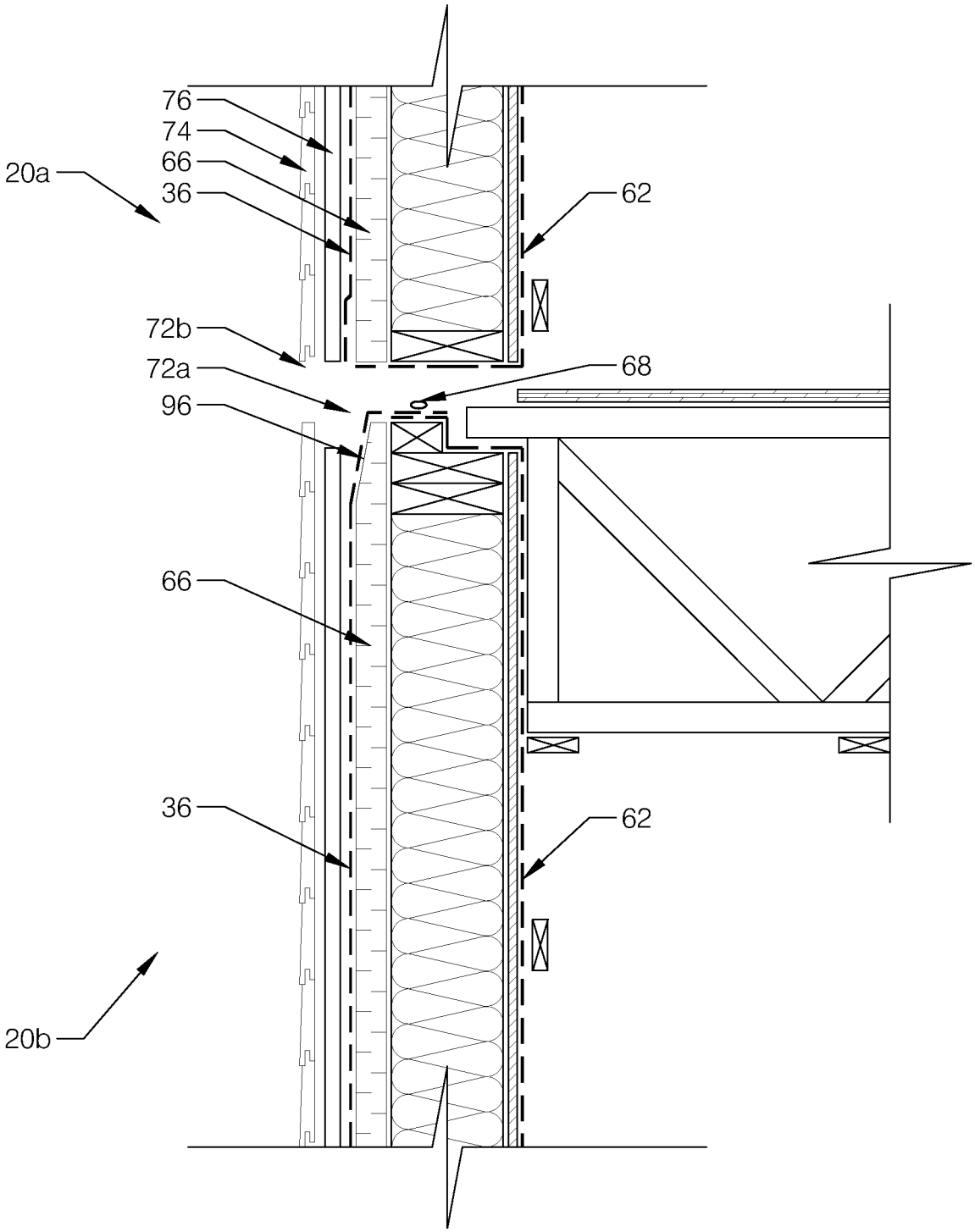
FIG. 7F is a cross-section view, fragmented, of two exterior wall panels configured in a spaced-apart configuration with a rigid heat insulating panel having a chamfered edge and a floor truss engageable therewith according to another embodiment.

FIG. 7F shows another embodiment of the exterior wall assembly 20, similar to the embodiment shown in FIGS. 7D and 7E but wherein the rigid heat insulating panel 66 has an upper chamfered edge 96. In the embodiment shown, the lower edge of the rigid heat insulating panel 66 of the upper wall panel 20*a* is straight. The chamfered edge 96 provides spacing for insertion of the second section of the rigid flashing 72*a*.

Figure 8:
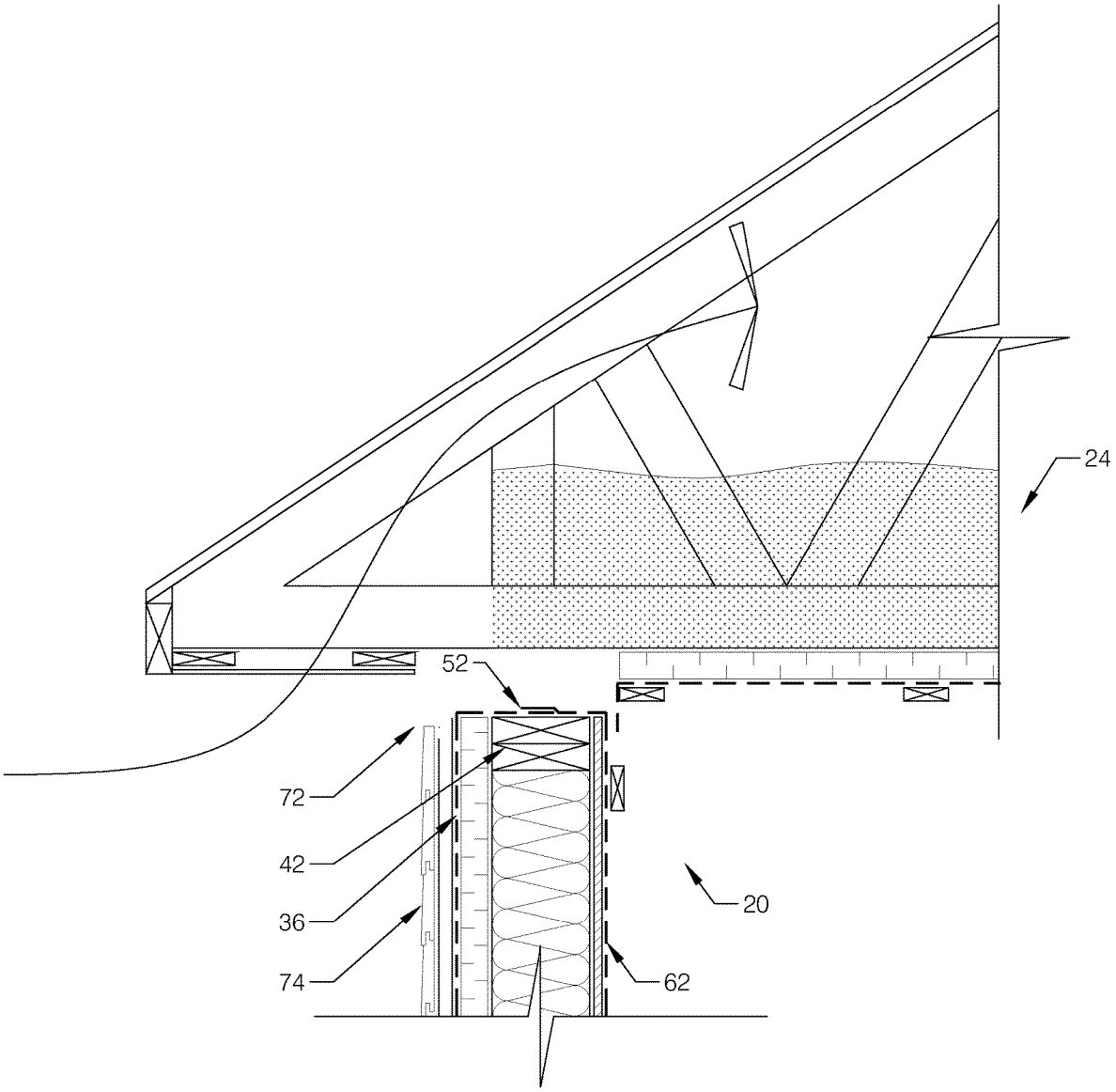
FIG. 8 is a cross-section view, fragmented, of an exterior wall panel adjacent to a roof structure according to an embodiment.

Referring to FIG. 8, there is shown an embodiment of the exterior wall panel 20 configured to be mounted adjacent to a roof structure 24. The upper peripheral edge 52 of the wall framework 42 is covered by a combination of the weather barrier membrane 36 and the vapor barrier membrane 62 with sections thereof being superposed to cover entirely the upper peripheral edge 52. A rigid flashing 72 seals the joint between the outer siding 74 and the weather barrier membrane 36 with the roof structure 24. An adhesive strip or any other suitable mechanical fastener (not shown) may be used to secure the weather barrier membrane 36 and the vapor barrier membrane 62 ends together and to the upper peripheral edge 52 of the wall framework 42.

Figure 9A:
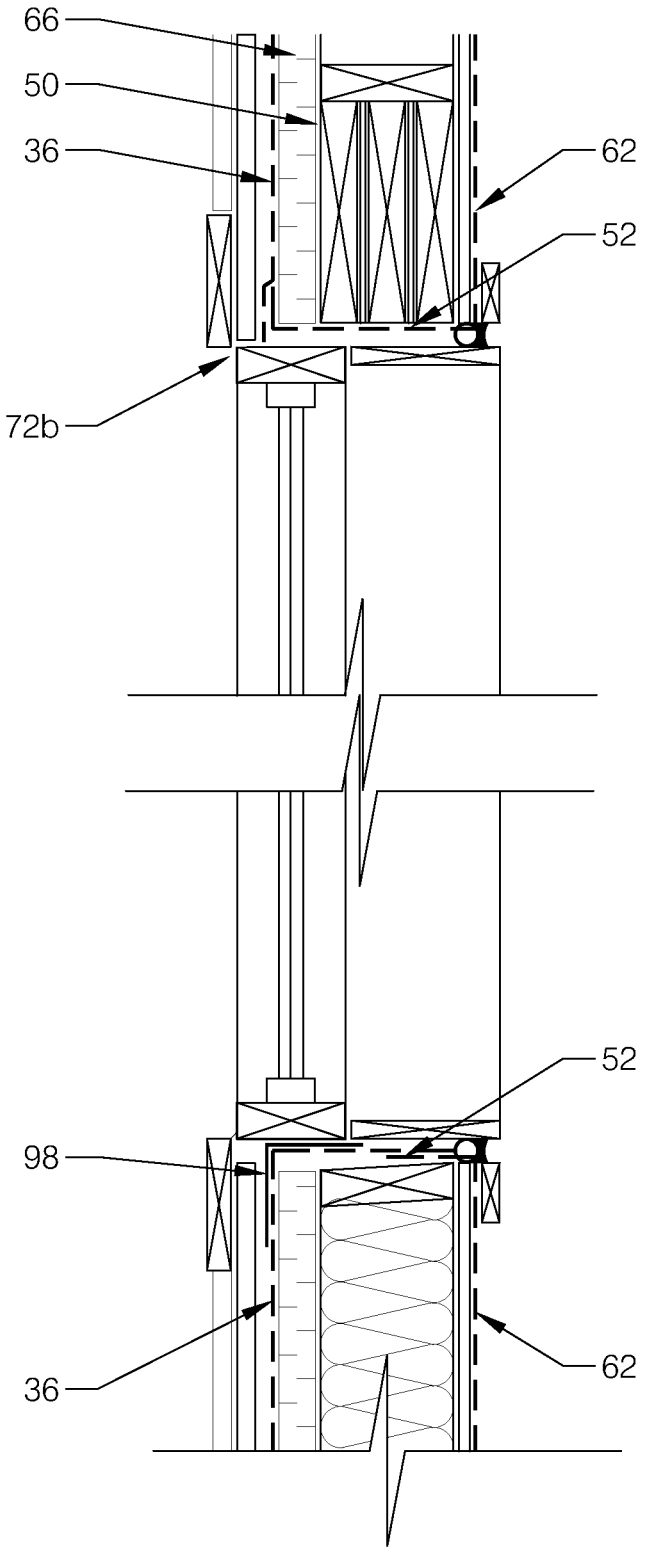
FIG. 9A is a cross-section view, fragmented, of two exterior wall panels adjacent to upper and lower edges of a window enclosure according to an embodiment.
Figure 9B:
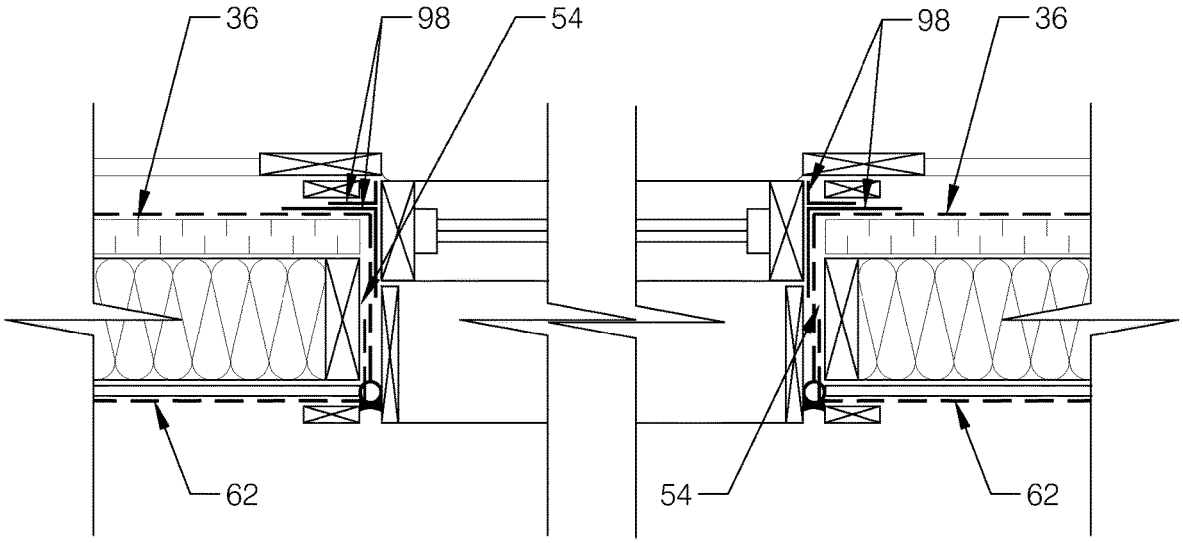
FIG. 9B is a cross-section view, fragmented, of two exterior wall panels mounted adjacent to each lateral side of a window or door enclosure according to an embodiment.

FIGS. 9A and 9B show alternative embodiments of the exterior wall panels to be respectively mounted adjacent to the upper and lower edges of a window enclosure and lateral sides of a window or door enclosure. As for the above-described embodiments, the peripheral edges 52, 54 of the exterior wall panels 20 are covered by a combination of the weather barrier membrane 36 and the vapor barrier membrane 62 which have a section thereof superposed to one another along the respective peripheral edge 52, 54. However, no bonding joint 68 is applied. It is however appreciated that, in an alternative embodiment, the exterior wall panel can be provided with a bonding joint applied to one of the vapor barrier membrane 62 and the weather barrier membrane 36 to contact the window or door frame members.

In the embodiment shown, for the lower peripheral edge 52 of an upper exterior wall panel, the vapor barrier membrane 62 extends along the lower peripheral edge 52 and has an end section extending upwardly and covering a lower portion of the outer wall surface 50. The end section of the vapor barrier membrane 62 is superposed to the rigid heat insulating panel 66 with the rigid flashing 72*b* and the weather barrier membrane 36 being superposed outwardly thereto.

In the embodiment shown, additional sealing membranes 98 are used between the weather barrier membrane 36 and the frame of a window enclosure or door.

Figure 10A:
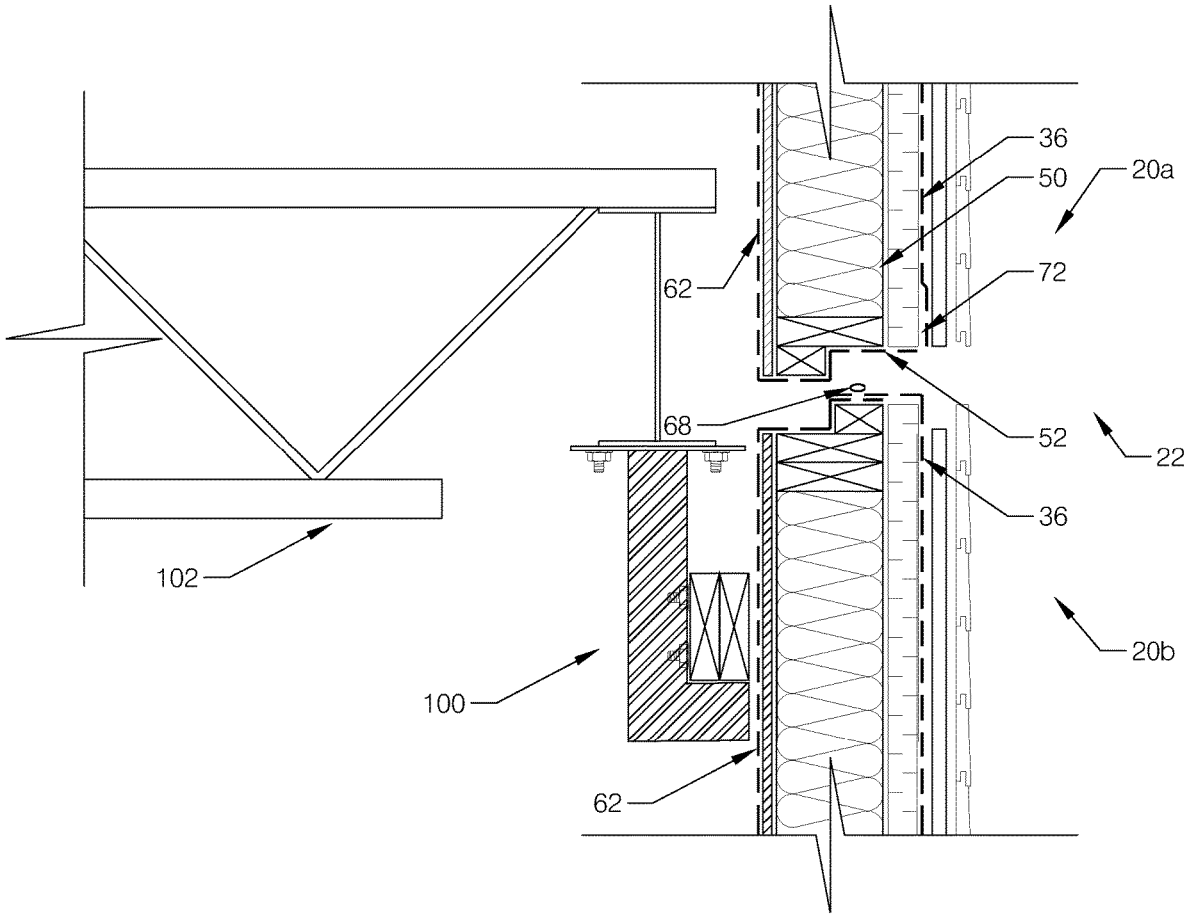
FIG. 10A is a cross-section view, fragmented, of two exterior wall panels and a floor truss mounted to a structural support securable to one of the two exterior wall panels.
Figure 10B:
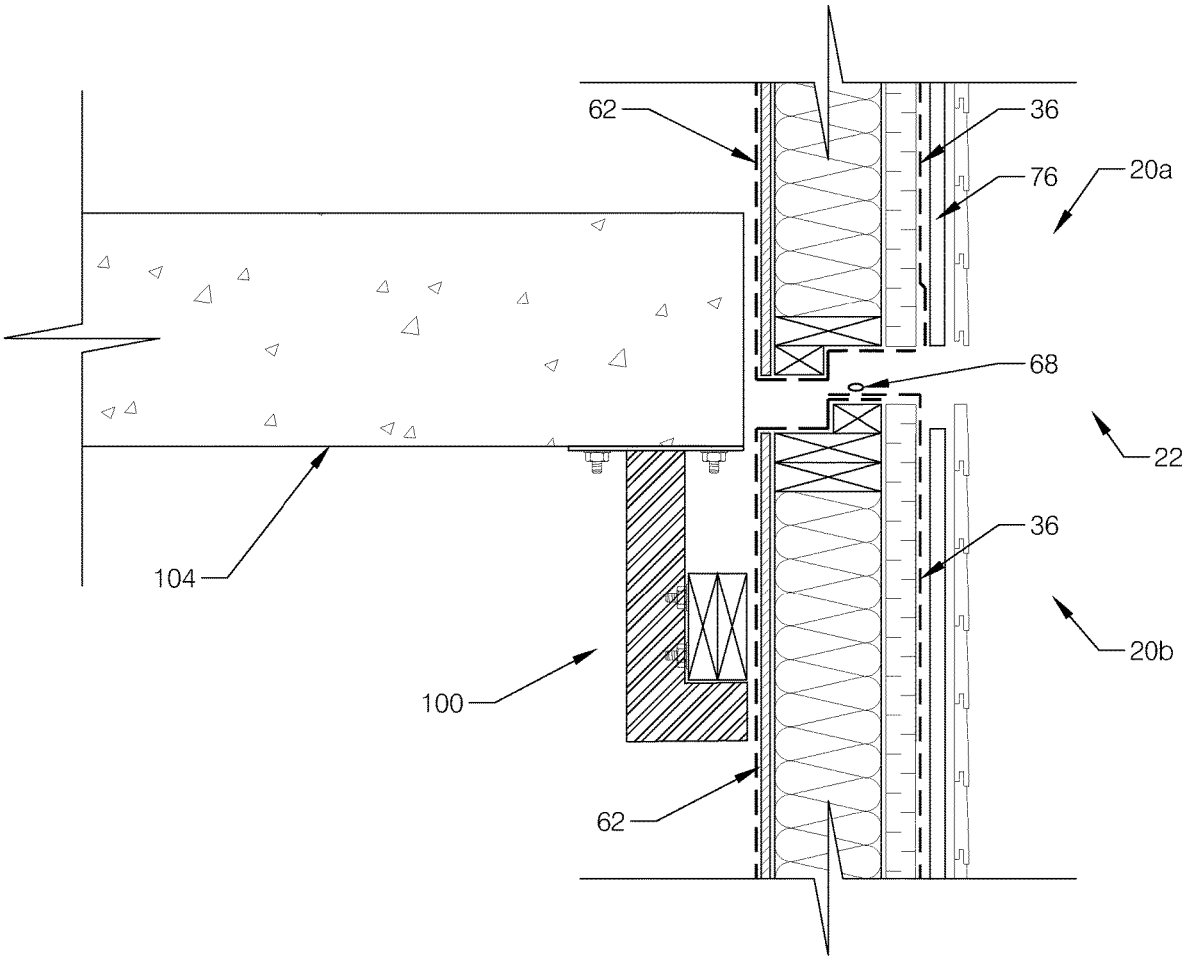
FIG. 10B is a cross-section view, fragmented, of two exterior wall panels and a concrete floor slab mounted to a structural support securable to one of the two exterior wall panels.

FIGS. 10A and 10B show embodiments of exterior wall panels 20, similar to the ones described above, to be engaged and secured together and form a wall assembly 22 onto which may attach a structural support 100. This support may for example, provide attachment means to a metal floor frame 102 or a concrete floor slab 104.

Figure 11A:
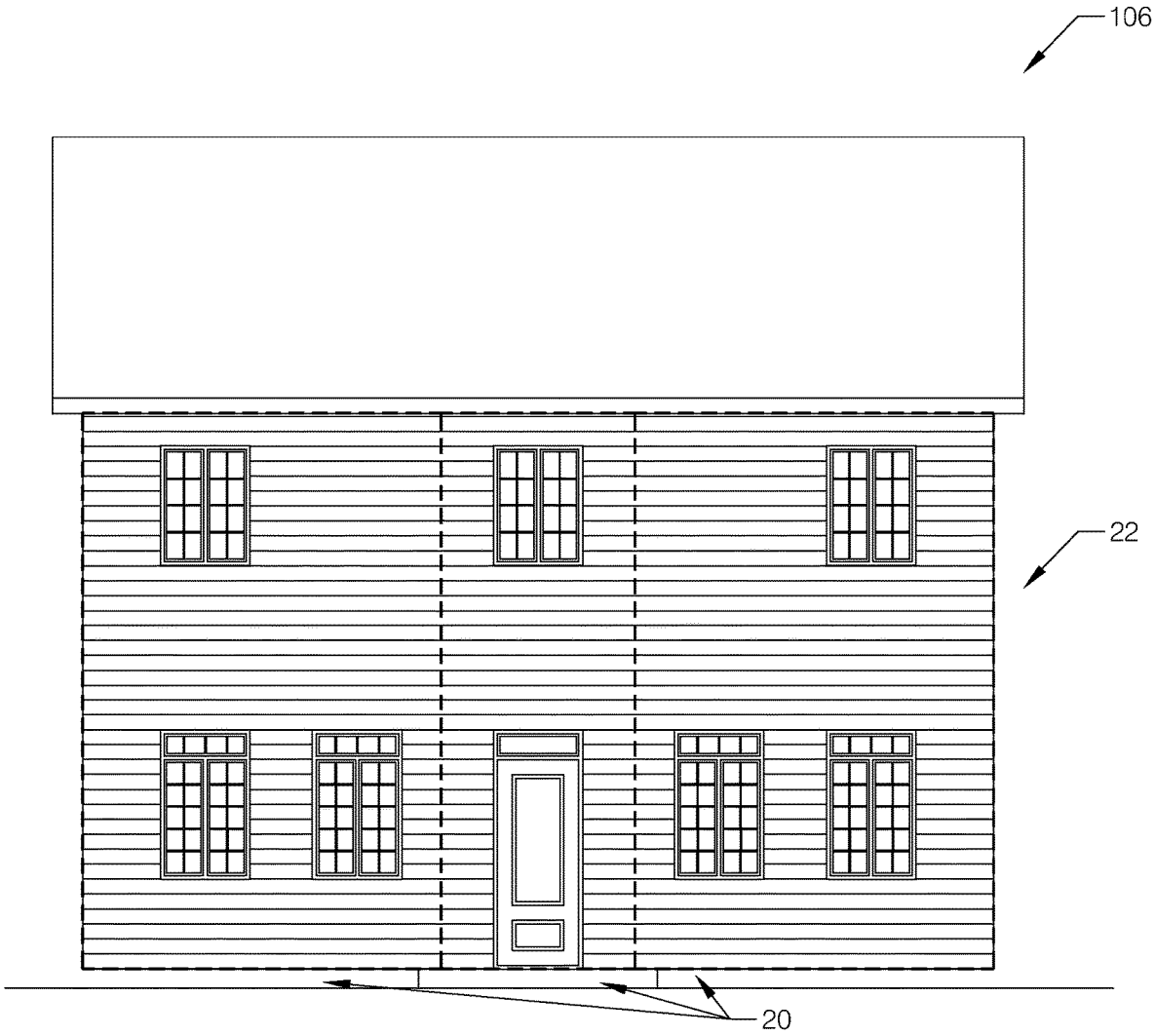
FIG. 11A is a schematic view of a residential building showing an exterior wall panel assembly with three exterior wall panels in a horizontally adjacent configuration.
Figure 11B:
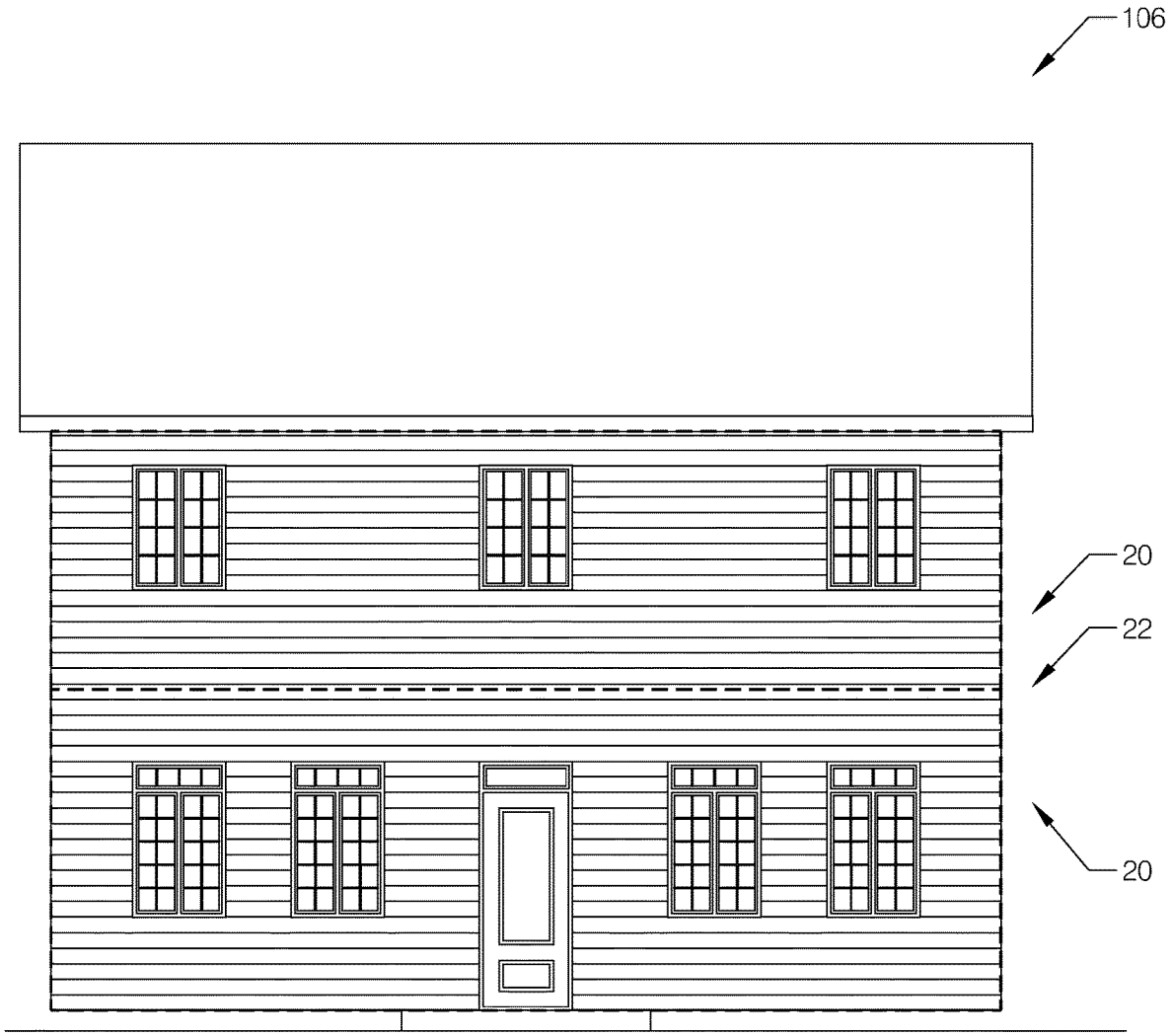
FIG. 11B is a schematic view of a residential building showing an exterior wall panel assembly with two exterior wall panels in a vertically adjacent configuration.

Finally, FIGS. 11A and 11B show in schematic views, a residential building 106 having an exterior wall panel assembly 22 comprising a plurality of exterior wall panels 20 configured in a horizontally-adjacent configuration on FIG. 11A and a vertically-adjacent configuration on FIG. 11B.

It is appreciated that several embodiments of exterior wall panels 22 and wall panel assemblies 20, resulting from the assembly of the exterior wall panels 22, have been described above. Combinations of the features of the different embodiments of exterior wall panels 22 and wall panel assemblies 20 can be foreseen.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. An exterior wall panel comprising:

a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges, the first and second pairs of spaced-apart peripheral edges extending between the inner and outer wall surfaces of the wall framework;

a vapor barrier membrane superposed to the inner wall surface;

a weather barrier membrane superposed to the outer wall surface;

wherein each peripheral edge of the first pair of spaced-apart peripheral edges and each peripheral edge of the second pair of spaced-apart peripheral edges of the wall framework are covered by at least one of the vapor barrier membrane and the weather barrier membrane with said at least one of the vapor barrier membrane and the weather barrier membrane being secured thereto;

a bonding joint extending along each peripheral edge of the first pair of spaced-apart peripheral edges and each peripheral edge of the second pair of spaced-apart peripheral edges and outwardly of the at least one of the vapor barrier membrane and the weather barrier membrane; and an outer siding extending outwardly of the weather barrier membrane along the outer wall surface.

2. The exterior wall panel as claimed in claim 1, wherein the vapor barrier membrane and the weather barrier membrane overlap along at least a portion of at least one peripheral edge of the first pair of spaced-apart peripheral edges and the second pair of spaced-apart peripheral edges.

3. The exterior wall panel as claimed in claim 1, wherein the bonding joint is applied to at least one of the vapor barrier membrane and the weather barrier membrane, the bonding joint contacting at least one of the vapor barrier membrane and the weather barrier membrane of another exterior wall panel when configured in an adjacent and abutting configuration.

4. The exterior wall panel as claimed in claim 1, wherein the bonding joint comprises a pressure sensitive adhesive strip.

5. The exterior wall panel as claimed in claim 1, further comprising a rigid flashing having a first section superposed to the outer wall surface and a second section extending past at least one of the first pair of spaced-apart peripheral edges and the second pair of spaced-apart peripheral edges.

6. The exterior wall panel as claimed in claim 5, wherein the first section of the rigid flashing is superposed and secured to one of the weather barrier membrane and the vapor barrier membrane and the second section of the rigid flashing is superposable and securable to one of a weather barrier membrane and a vapor barrier membrane of an adjacently configured exterior wall panel.

7. The exterior wall panel as claimed in claim 6, wherein the second section is superposable outwardly to the weather barrier membrane of the adjacently configured exterior wall panel.

8. The exterior wall panel as claimed in claim 5, wherein the first section of the rigid flashing is inserted between the wall framework and the weather barrier membrane.

9. The exterior wall panel as claimed in claim 1, further comprising:

a rigid heat insulating panel superposed to the wall framework outwardly thereof with the weather barrier membrane being superposed outwardly to the rigid heat insulating panel; and a plurality of spaced-apart slats extending between the weather barrier membrane and the outer siding;

wherein the outer siding extends outwardly over the rigid heat insulating panel and the weather barrier membrane.

10. The exterior wall panel as claimed in claim 9, wherein said plurality of spaced-apart slats are configured in a superimposed configuration and form a plurality of slat layers between the weather barrier membrane and the outer siding.

11. The exterior wall panel as claimed in claim 9, further comprising a rigid flashing having:

a first section superposed and secured to the rigid heat insulating panel and at least partially covered outwardly by the weather barrier membrane; and a second section extending past at least one of the first pair of spaced-apart peripheral edges and the second pair of spaced-apart peripheral edges and superposable outwardly to a weather barrier membrane of an adjacently configured exterior wall panel.

12. The exterior wall panel as claimed in claim 11, wherein the first section of the rigid flashing is at least partially sandwiched between the weather barrier membrane and the vapor barrier membrane.

13. The exterior wall panel as claimed in claim 11, wherein the first section of the rigid flashing extends between the rigid heat insulating panel and the weather barrier membrane.

14. The exterior wall panel as claimed in claim 11, further comprising a structural panel abutting against and mounted to the wall framework inwardly thereof and extending at least partially between the vapor barrier membrane and the wall framework.

15. The exterior wall panel as claimed in claim 14, wherein the wall framework defines an inner space and the exterior wall panel further comprises a heat insulating layer extending inside the inner space and between the structural panel and the rigid heat insulating panel.

16. The exterior wall panel as claimed in claim 11, wherein the rigid heat insulating panel comprises a beveled edge extending downwardly from the outer wall surface and the second section of the rigid flashing is superposable to the beveled edge of the adjacently configured exterior wall panel.

17. The exterior wall panel as claimed in claim 1, wherein the first pair of spaced-apart peripheral edges includes an upper edge and a lower edge and the second pair of spaced-apart peripheral edges includes first and second side edges.

18. An exterior wall panel assembly, comprising a plurality of exterior wall panels according to claim 1, said plurality of exterior wall panels being configured in an adjacent and abutting configuration.

19. A method for forming an exterior wall panel assembly, comprising:

providing first and second exterior wall panels as claimed in claim 1, configuring the second exterior wall panel in an adjacent and abutting configuration with regards to the first exterior wall panel, wherein at least one of the first pair of spaced-apart peripheral edges and the second pair of spaced-apart peripheral edges of the second exterior wall panel contacts the bonding joint.

20. An exterior wall panel assembly, comprising a plurality of exterior wall panels configured in an adjacent and abutting configuration, each one of said plurality of exterior wall panels comprising:

a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges, the first and second pairs of spaced-apart peripheral edges extending between the inner and outer wall surfaces of the wall framework;

a vapor barrier membrane superposed to the inner wall surface;

a weather barrier membrane superposed to the outer wall surface;

wherein each peripheral edge of the first pair of spaced-apart peripheral edges and each peripheral edge of the second pair of spaced-apart peripheral edges is-are covered by at least one of the vapor barrier membrane and the weather barrier membrane with said at least one of the vapor barrier membrane and the weather barrier membrane being secured thereto;

a bonding joint extending along each peripheral edge of the first pair of spaced-apart peripheral edges and each peripheral edge of the second pair of spaced-apart peripheral edges and outwardly of the at least one of the vapor barrier membrane and the weather barrier membrane; and an outer siding extending outwardly of the weather barrier membrane along the outer wall surface.

21. An exterior wall panel comprising:

a wall framework comprising a plurality of horizontal stud members and a plurality of vertical stud members defining together an inner wall surface and an outer wall surface, spaced-apart from the inner wall surface, the wall framework having a first pair of spaced-apart peripheral edges and a second pair of spaced-apart peripheral edges extending between the first pair of spaced-apart peripheral edges, the first and second pairs of spaced-apart peripheral edges extending between the inner and outer wall surfaces of the wall framework;

a vapor barrier membrane superposed to the inner wall surface;

a weather barrier membrane superposed to the outer wall surface;

wherein each peripheral edge of the first pair of spaced-apart peripheral edges and each peripheral edge of the second pair of spaced-apart peripheral edges of the wall framework are covered by at least one of the vapor barrier membrane and the weather barrier membrane with said at least one of the vapor barrier membrane and the weather barrier membrane being secured thereto;

a bonding joint extending along each peripheral edge of the first pair of spaced-apart peripheral edges and each peripheral edge of the second pair of spaced-apart peripheral edges and outwardly of the at least one of the vapor barrier membrane and the weather barrier membrane;

an outer siding extending outwardly of the weather barrier membrane along the outer wall surface; and a rigid flashing having a first section superposed to the outer wall surface and a second section extending past at least one of the first pair of spaced-apart peripheral edges and the second pair of spaced-apart peripheral edges;

wherein the first section of the rigid flashing is inserted between the wall framework and the weather barrier membrane.

22. The exterior wall panel as claimed in claim 21, wherein the vapor barrier membrane and the weather barrier membrane overlap along at least a portion of at least one peripheral edge of the first pair of spaced-apart peripheral edges and the second pair of spaced-apart peripheral edges.

23. The exterior wall panel as claimed in claim 21, wherein the bonding joint is applied to at least one of the vapor barrier membrane and the weather barrier membrane, the bonding joint contacting at least one of the vapor barrier membrane and the weather barrier membrane of another exterior wall panel when configured in an adjacent and abutting configuration.

24. The exterior wall panel as claimed in claim 21, wherein the first pair of spaced-apart peripheral edges includes an upper edge and a lower edge and the second pair of spaced-apart peripheral edges includes first and second side edges.

25. An exterior wall panel assembly, comprising a plurality of exterior wall panels according to claim 21, said plurality of exterior wall panels being configured in an adjacent and abutting configuration.

* * * * *